US011454055B2

(12) United States Patent
Van Essen

(10) Patent No.: US 11,454,055 B2
(45) Date of Patent: Sep. 27, 2022

(54) WINDOW OPENING CONTROL SYSTEMS AND METHODS

(71) Applicant: Pella Corporation, Pella, IA (US)

(72) Inventor: Jesse Van Essen, Shenandoah, IA (US)

(73) Assignee: Pella Corporation, Pella, IA (US)

( * ) Notice: Subject to any disclaimer, the term of this patent is extended or adjusted under 35 U.S.C. 154(b) by 930 days.

(21) Appl. No.: 15/874,589

(22) Filed: Jan. 18, 2018

(65) Prior Publication Data

US 2018/0209186 A1 Jul. 26, 2018

Related U.S. Application Data

(60) Provisional application No. 62/448,615, filed on Jan. 20, 2017.

(51) Int. Cl.
*E05C 17/02* (2006.01)
*E05C 7/02* (2006.01)
(Continued)

(52) U.S. Cl.
CPC ..... *E05C 17/02* (2013.01); *E05C 7/02* (2013.01); *E05C 17/50* (2013.01); *E05C 5/02* (2013.01); *E05C 19/008* (2013.01); *E05C 2005/005* (2013.01); *E05C 2007/007* (2013.01); *Y10S 292/20* (2013.01); *Y10S 292/47* (2013.01); *Y10T 292/089* (2015.04); *Y10T 292/0863* (2015.04);
(Continued)

(58) Field of Classification Search
CPC ..... E05C 2005/005; E05C 5/02; E05C 2007/007; E05C 7/02; E05C 17/02; E05C 17/50; E05C 19/007; E05C 19/008; E05B 15/0086; E05B 65/08; Y10S 292/20; Y10S 292/47; Y10S 292/49; Y10T 292/0863; Y10T 292/0864; Y10T 292/0867; Y10T 292/0868; Y10T 292/0886; Y10T 292/0887; Y10T 292/0889; Y10T 292/089; Y10T 292/0891; Y10T 292/1051; Y10T 292/42; Y10T 292/444; Y10T 292/54; Y10T 292/546; Y10T 292/552; Y10T 292/558; Y10T 292/564; Y10T 292/71
USPC ..... 292/57, 58, 60, 61, 63, 64, 65, 66, 67, 292/219, 300, 304, 332, 333, 334, 335, 292/336, 342, DIG. 20, DIG. 47, DIG. 49
See application file for complete search history.

(56) References Cited

U.S. PATENT DOCUMENTS 37,625 A 2/1863 Hyde
89,606 A 5/1869 Strongfllow
(Continued)

FOREIGN PATENT DOCUMENTS

CN 101080542 A 11/2007
CN 101131061 A 2/2008
(Continued)

*Primary Examiner* — Christine M Mills
*Assistant Examiner* — Faria F Ahmad
(74) *Attorney, Agent, or Firm* — Faegre Drinker Biddle & Reath LLP

(57) ABSTRACT

A fenestration system is disclosed. In some examples, the fenestration system includes one or more movable window sashes and a toggle assembly. In some examples, the toggle assembly operates to limit the degree to which the window sashes are opened or otherwise moved relative to one another. In some examples, a window sash may be opened a designated amount before the toggle assembly operates to obstruct it from being further opened.

20 Claims, 27 Drawing Sheets

(51) Int. Cl.

| | |
|---|---|
| ***E05C 17/50*** | (2006.01) |
| ***E05C 5/00*** | (2006.01) |
| ***E05C 5/02*** | (2006.01) |
| ***E05C 19/00*** | (2006.01) |
| ***E05C 7/00*** | (2006.01) |

(52) U.S. Cl.

CPC .... *Y10T 292/0864* (2015.04); *Y10T 292/0867* (2015.04); *Y10T 292/0868* (2015.04); *Y10T 292/0886* (2015.04); *Y10T 292/0887* (2015.04); *Y10T 292/0889* (2015.04); *Y10T 292/0891* (2015.04); *Y10T 292/1051* (2015.04); *Y10T 292/42* (2015.04); *Y10T 292/444* (2015.04); *Y10T 292/54* (2015.04); *Y10T 292/546* (2015.04); *Y10T 292/552* (2015.04); *Y10T 292/558* (2015.04); *Y10T 292/564* (2015.04); *Y10T 292/71* (2015.04)

(56) References Cited

U.S. PATENT DOCUMENTS 105,287 A 7/1870 Wood
196,002 A * 10/1877 Freeman ..... E05F 11/00 292/342
198,553 A 12/1877 Von Auer
226,033 A 3/1880 Burns
262,530 A 8/1882 Zacherl
278,802 A 6/1883 Kubleb
281,865 A 7/1883 Goodwin
327,858 A 10/1885 Bradford
383,886 A * 6/1888 Jackson ..... E05B 85/24 292/198
385,935 A * 7/1888 Jackson ..... E05B 85/24 292/198
398,889 A * 3/1889 Gehrung ..... E05B 63/20 292/334
423,217 A * 3/1890 Chambers ..... E05F 11/00 292/228
426,792 A 4/1890 Foote
443,356 A * 12/1890 Cattley ..... E05B 63/20 292/336
489,442 A 1/1893 Whetter
501,622 A 7/1893 Lee
521,691 A * 6/1894 Algeo ..... E05B 83/02 292/187
523,736 A 7/1894 Cazin
534,185 A * 2/1895 Winchester ..... E05B 65/0852 292/63
551,181 A 12/1895 Dillon
685,466 A 10/1901 Bradshaw
696,557 A * 4/1902 George ..... E05F 11/00 292/238
718,007 A 1/1903 Linn
756,453 A 4/1904 Arens et al.
763,240 A 6/1904 Aupke
779,801 A 1/1905 Prden
798,369 A 8/1905 Stutenroth
798,544 A 8/1905 Horssen
804,994 A 11/1905 Andrews
812,097 A 2/1906 Stanley et al.
820,960 A 5/1906 Erb
820,961 A 5/1906 Erb
823,070 A * 6/1906 McEntee ..... E05B 85/24 292/229
908,394 A 12/1908 Corbeille
917,379 A * 4/1909 Tayntor ..... E05C 5/00 292/67
928,526 A 7/1909 Loper
956,963 A 5/1910 Harmuth
976,777 A 11/1910 Brown
984,669 A 2/1911 Hedstrom
1,016,422 A 2/1912 Lauritsen
1,032,559 A * 7/1912 McKee ..... E05B 15/0093 292/230
1,069,079 A 7/1913 Voight
1,082,663 A 12/1913 Viragh
1,134,203 A 4/1915 Jones
1,173,129 A * 2/1916 Taliaferro ..... E05B 65/0852 292/219
1,184,148 A 5/1916 Teisseire
1,193,211 A 8/1916 Webster
1,198,138 A 9/1916 Lovell
1,214,602 A 2/1917 Smith
1,220,675 A 3/1917 Parson
1,222,293 A 4/1917 Iman
1,261,274 A 4/1918 Newsam
1,282,490 A 10/1918 Sullwold
1,313,401 A 8/1919 Mann
1,322,677 A 11/1919 Ditlefsen
1,325,790 A 12/1919 Kleinschmidt
1,327,441 A 1/1920 Mesker et al.
1,350,698 A 8/1920 Boedtcher
1,358,121 A 11/1920 Smith
1,361,913 A 12/1920 Sebastian
1,397,859 A 11/1921 Dickens
1,439,260 A * 12/1922 Pruell ..... E05D 13/08 292/242
1,445,267 A 2/1923 Card
1,469,331 A 10/1923 Chester et al.
1,494,948 A 5/1924 Bujack
1,511,363 A 10/1924 Pierson
1,514,927 A * 11/1924 Powers ..... E05F 11/00 292/242
1,533,725 A 4/1925 Davenport
1,538,222 A 5/1925 Smith
1,549,422 A * 8/1925 Mohun ..... B61D 25/00 292/100
1,601,773 A 10/1926 Sasgen
1,605,883 A 11/1926 Wheelock
1,644,814 A 10/1927 Barr
1,649,861 A 11/1927 Schneider
1,651,697 A 12/1927 Hadden
1,653,295 A * 12/1927 Kozak ..... E05F 11/00 292/194
1,653,830 A * 12/1927 Wharton ..... E05C 17/54 292/343
1,664,322 A 3/1928 Reese
1,694,886 A 12/1928 McClellan
1,707,888 A 4/1929 White
1,708,556 A 4/1929 Storms
1,724,637 A 8/1929 Bergstrom
1,747,576 A * 2/1930 Caldwell ..... E06B 3/50 49/186
1,812,288 A * 6/1931 Drapeau ..... E05B 65/0864 292/175
1,835,558 A 12/1931 Campbell
1,899,466 A 2/1933 Kistner
1,905,983 A * 4/1933 Harder ..... E05D 13/06 292/228
1,906,153 A * 4/1933 Hall ..... E05F 11/00 292/81
1,945,748 A * 2/1934 McDaniel ..... E05C 17/54 116/17
1,946,833 A 2/1934 Brown
1,960,543 A * 5/1934 Maguire ..... E05F 11/00 292/207
1,988,810 A 1/1935 Ross
2,011,455 A * 8/1935 Ostermann ..... E05D 13/06 292/218
2,062,020 A 11/1936 Sylvan
2,137,937 A * 11/1938 Berghoff ..... E05C 17/54 292/261
2,158,260 A 5/1939 Stillman
2,405,887 A 8/1946 Hoffman
2,480,988 A * 9/1949 Walton ..... E05D 13/06 292/218
2,503,370 A * 4/1950 Zanona ..... E05F 11/00 292/198
2,527,278 A * 10/1950 Schemansky ..... E05F 11/00 292/194
2,612,398 A * 9/1952 Miller ..... E05F 11/00 292/230

(56) References Cited

U.S. PATENT DOCUMENTS 2,788,098 A 4/1957 Bianco
3,083,045 A 3/1963 Linderoth
3,109,675 A * 11/1963 Anderson ..... E05C 19/14 292/109
3,151,901 A 10/1964 Aldgren
3,157,224 A 11/1964 Spargur et al.
3,330,071 A 7/1967 Kubisiak
3,337,992 A 8/1967 Tolson
3,456,387 A 7/1969 Tolson
3,897,966 A 8/1975 Draughon, Sr.
3,910,614 A 10/1975 Coe
3,912,311 A 10/1975 Carvell et al.
4,027,907 A 6/1977 Crepinsek
4,095,827 A 6/1978 Stavenau
4,248,461 A 2/1981 Stevens
4,263,747 A 4/1981 Coltrin et al.
4,377,969 A 3/1983 Nelson
4,379,576 A 4/1983 Blough et al.
4,383,666 A 5/1983 Allerding et al.
4,577,896 A 3/1986 Crepinsek
4,580,819 A 4/1986 Crepinsek
4,580,820 A 4/1986 Baber
4,635,976 A 1/1987 Sigler
4,639,024 A 1/1987 Crepinsek
4,897,961 A 2/1990 Shine
4,923,230 A * 5/1990 Simpson ..... E05B 65/0852 292/338
5,144,770 A 9/1992 Kraus et al.
5,248,174 A 9/1993 Matz et al.
5,452,596 A 9/1995 Yamada
5,457,971 A 10/1995 Yamada
5,502,925 A 4/1996 Gorrell
5,536,052 A 7/1996 Maier
5,553,420 A 9/1996 Klimek
5,553,903 A * 9/1996 Prete ..... E05B 9/08 292/138
5,568,702 A 10/1996 Frank et al.
5,568,703 A 10/1996 Frank et al.
5,573,050 A * 11/1996 Henkenjohann ..... E06B 9/86 160/133
5,575,116 A 11/1996 Carlson et al.
5,615,522 A 4/1997 Tomanek
5,620,213 A * 4/1997 Ellis ..... E05B 13/10 292/100
5,636,476 A 6/1997 Eikmeier et al.
5,647,233 A 7/1997 Chung
5,669,256 A 9/1997 Chung
5,682,710 A 11/1997 Davies et al.
5,687,506 A 11/1997 Davies et al.
5,715,631 A 2/1998 Kailian et al.
5,775,028 A 7/1998 Lambert
5,806,900 A 9/1998 Bratcher et al.
5,826,377 A 10/1998 Simson et al.
5,839,229 A 11/1998 Briggs et al.
5,881,498 A 3/1999 Goggin et al.
5,937,582 A 8/1999 Taylor
5,946,857 A 9/1999 Davies et al.
5,997,053 A * 12/1999 Marquez ..... E05C 17/085 292/153
6,000,735 A 12/1999 Jourdenais
6,021,603 A 2/2000 Prete et al.
6,161,336 A 12/2000 Ziv-Av
6,209,364 B1 4/2001 Collet et al.
6,270,175 B1 8/2001 Sfeir
D453,214 S 1/2002 Komatsubara et al.
6,343,436 B1 2/2002 Milano et al.
6,354,639 B1 3/2002 Minter et al.
6,364,375 B1 4/2002 Szapucki et al.
6,381,080 B1 4/2002 Holdener et al.
6,382,689 B1 5/2002 Brown
6,384,990 B1 5/2002 Holdener et al.
6,431,620 B2 8/2002 Tremblay et al.
6,442,898 B1 9/2002 Wu
6,484,445 B2 11/2002 Chang
6,546,671 B2 4/2003 Mitchell et al.
6,619,707 B2 9/2003 Sucu et al.
6,634,681 B1 10/2003 Redden
6,684,454 B2 2/2004 Ehrenreich
6,817,142 B2 11/2004 Marshik
6,871,884 B2 3/2005 Hoffmann et al.
6,871,885 B2 3/2005 Goldenberg et al.
6,915,608 B2 7/2005 Labarre
6,926,363 B2 8/2005 Yamashita
6,968,646 B2 11/2005 Goldenberg et al.
7,013,603 B2 3/2006 Eenigenburg et al.
7,017,301 B2 3/2006 Di Vinadio
7,024,821 B2 4/2006 Lu
7,036,274 B2 5/2006 Carrier
7,048,312 B2 5/2006 Brunner
7,063,361 B1 6/2006 Lawrence
7,093,392 B2 8/2006 Derham et al.
7,100,327 B2 9/2006 Rangabasyam et al.
7,147,255 B2 12/2006 Goldenberg et al.
7,159,908 B2 1/2007 Liang
7,216,401 B2 5/2007 Bae
7,246,411 B2 7/2007 Campbell et al.
7,246,840 B2 7/2007 Gates et al.
7,257,864 B2 8/2007 Liang et al.
7,296,831 B2 11/2007 Generowicz et al.
D558,024 S 12/2007 Tremble et al.
7,305,800 B1 12/2007 Calfee
D559,078 S 1/2008 Baczuk et al.
D560,112 S 1/2008 Baczuk et al.
7,325,359 B2 2/2008 Vetter
7,396,054 B2 7/2008 Carrier
7,412,800 B2 8/2008 Maier
7,431,356 B2 * 10/2008 Liang ..... E05B 65/0852 292/219
7,441,812 B2 10/2008 Welsh et al.
D581,247 S 11/2008 Durrant
7,464,619 B2 12/2008 Vetter
7,494,164 B1 2/2009 Garries et al.
7,530,611 B2 * 5/2009 Liang ..... E05B 65/0829 292/338
7,559,588 B2 * 7/2009 Liang ..... E05D 13/00 16/82
7,588,271 B1 9/2009 Lawrence
7,600,796 B2 * 10/2009 Liang ..... E05C 17/50 292/207
7,614,184 B2 11/2009 Rebel et al.
7,637,544 B2 * 12/2009 Liang ..... E05C 17/50 292/338
7,913,456 B2 3/2011 Balbo Di Vinadio
7,963,577 B2 6/2011 Wolf
7,971,392 B2 7/2011 Seo
8,046,954 B2 11/2011 Curtis et al.
8,051,604 B2 11/2011 Diekmann et al.
8,075,038 B2 12/2011 Zielinsky
8,087,322 B1 1/2012 Morris
8,096,593 B2 1/2012 Gibbons
8,156,612 B2 4/2012 Yamashita
8,171,673 B2 5/2012 Helms
8,182,001 B2 5/2012 Tremble et al.
8,235,430 B2 * 8/2012 Liang ..... E05B 15/04 292/338
8,281,458 B2 10/2012 Balbo Di Vinadio
8,308,204 B2 11/2012 Lindgren et al.
8,336,930 B2 12/2012 Liang et al.
8,360,484 B2 1/2013 Liang et al.
8,448,996 B2 5/2013 Lake et al.
8,474,186 B2 7/2013 Dufour et al.
8,490,330 B2 7/2013 Lund et al.
8,511,724 B2 8/2013 Liang et al.
8,550,507 B2 * 10/2013 Barton ..... E05B 63/20 292/194
8,602,463 B2 12/2013 Keighley et al.
8,657,347 B2 2/2014 Liang et al.
8,683,746 B2 4/2014 Lambertini
8,707,621 B2 4/2014 Curtis et al.
8,727,395 B2 5/2014 Nania
8,733,021 B2 5/2014 Lambertini
8,769,872 B2 7/2014 Maltaverne et al.

(56) References Cited

U.S. PATENT DOCUMENTS 8,776,440 B2 * 7/2014 Sopkowiak ..... E05B 65/0835 292/338
8,776,441 B1 * 7/2014 Lawrence ..... E05B 65/0852 292/DIG. 47
8,776,442 B1 * 7/2014 Lawrence ..... E05B 9/08 292/DIG. 47
8,789,857 B2 7/2014 Liang et al.
8,789,862 B2 * 7/2014 Liang ..... E05B 63/0056 292/300
8,806,809 B1 * 8/2014 Lawrence ..... E05D 13/06 292/338
D712,280 S 9/2014 Radomyselski et al.
8,881,461 B2 * 11/2014 Derham ..... E05C 3/12 49/449
8,888,146 B2 11/2014 Taylor et al.
8,899,632 B2 12/2014 Tremble et al.
8,919,699 B2 12/2014 Kress et al.
8,925,150 B2 1/2015 Pacini
8,935,887 B2 1/2015 Cavalcante
8,950,119 B2 * 2/2015 Piltingsrud ..... E05C 17/46 49/449
8,991,228 B2 3/2015 Yang
9,163,437 B1 10/2015 Lawrence
9,234,374 B2 1/2016 Wolf et al.
9,273,763 B2 3/2016 Evensen
9,404,288 B2 8/2016 Curtis et al.
9,435,149 B1 * 9/2016 Glickman ..... E05C 17/50
9,441,714 B2 9/2016 Hsu et al.
9,556,652 B2 1/2017 Lund
D795,848 S 8/2017 Zheng et al.
9,725,935 B2 * 8/2017 Tomassi ..... E05C 19/00
9,745,784 B1 8/2017 Lawrence
9,759,001 B2 9/2017 Bisang et al.
9,772,010 B2 9/2017 Dodge et al.
9,840,860 B2 * 12/2017 Liang ..... E05B 63/0056
D808,256 S 1/2018 Muller
9,889,725 B2 2/2018 Boesel et al.
10,107,021 B1 * 10/2018 Liang ..... E05B 65/0835
2001/0019211 A1 9/2001 Tremblay et al.
2002/0116874 A1 8/2002 Marshik
2002/0119000 A1 8/2002 Gledhill
2002/0124468 A1 9/2002 Manzella
2002/0144465 A1 10/2002 Chang
2002/0145291 A1 10/2002 Goldenberg et al.
2002/0162223 A1 11/2002 Reichert
2002/0167180 A1 11/2002 Sucu et al.
2003/0014920 A1 1/2003 Lu
2003/0024168 A1 2/2003 Mitchell et al.
2003/0047949 A1 3/2003 Brunner
2003/0079414 A1 5/2003 Rangabasyam et al.
2003/0110699 A1 6/2003 Eenigenburg et al.
2003/0110701 A1 6/2003 Dawson
2003/0122387 A1 7/2003 Ward
2003/0159477 A1 8/2003 Hoffmann et al.
2003/0167694 A1 9/2003 Liang
2003/0172591 A1 9/2003 Labarre
2004/0036299 A1 2/2004 Goldenberg et al.
2004/0036300 A1 2/2004 Goldenberg et al.
2004/0128914 A1 7/2004 Hempelmann
2004/0216381 A1 11/2004 Clavet
2004/0216541 A1 11/2004 Vetter
2004/0245801 A1 12/2004 Gates et al.
2004/0261320 A1 12/2004 Sullivan
2005/0011049 A1 1/2005 Muir
2005/0022941 A1 2/2005 Di Vinadio
2005/0046260 A1 3/2005 Yamashita
2005/0055804 A1 3/2005 Liang et al.
2005/0072075 A1 4/2005 Maier
2005/0078818 A1 4/2005 Bae
2005/0132532 A1 6/2005 Campbell et al.
2005/0262769 A1 12/2005 Vetter
2006/0032143 A1 2/2006 Johnson
2006/0053692 A1 3/2006 Rebel et al.
2006/0087130 A1 4/2006 Liang
2006/0218864 A1 10/2006 Blomqvist
2006/0244269 A1 11/2006 Rotondi
2007/0020091 A1 1/2007 Giaimo et al.
2007/0020092 A1 1/2007 Giaimo et al.
2007/0040396 A1 2/2007 Carrier
2007/0137110 A1 6/2007 Liles, Jr.
2007/0158953 A1 7/2007 Liang
2007/0182168 A1 8/2007 Allen
2007/0222233 A1 9/2007 Liang et al.
2007/0222234 A1 * 9/2007 Liang ..... E05C 17/50 292/338
2008/0000164 A1 1/2008 Erickson et al.
2008/0001413 A1 1/2008 Lake et al.
2008/0040978 A1 2/2008 Diekmann et al.
2008/0092446 A1 4/2008 Bienek
2008/0120915 A1 5/2008 Flores
2008/0129054 A1 6/2008 Tremble et al.
2008/0178424 A1 7/2008 Tuller
2008/0229667 A1 9/2008 Dufour et al.
2008/0250719 A1 10/2008 Griffin et al.
2008/0256874 A1 10/2008 Curtis et al.
2009/0013605 A1 1/2009 Seo
2009/0025301 A1 1/2009 Di Vinadio
2009/0079202 A1 3/2009 Wolf
2009/0146436 A1 6/2009 Lindgren et al.
2009/0206616 A1 * 8/2009 Liang ..... E05C 17/60 292/338
2010/0050524 A1 3/2010 Helms
2010/0072763 A1 3/2010 Allen
2010/0089190 A1 4/2010 Busch
2010/0139039 A1 6/2010 Balbo Di Vinadio
2010/0192643 A1 8/2010 Liang et al.
2010/0276947 A1 11/2010 Keighley et al.
2010/0293748 A1 11/2010 Yamashita
2010/0300000 A1 * 12/2010 Liang ..... E05B 65/0829 49/449
2011/0062727 A1 3/2011 Liang et al.
2011/0068124 A1 3/2011 Reynolds et al.
2011/0173895 A1 7/2011 Lund et al.
2011/0203184 A1 8/2011 Nguyen et al.
2011/0298225 A1 12/2011 Liang et al.
2012/0023826 A1 2/2012 Curtis et al.
2012/0068478 A1 3/2012 Nania
2012/0144752 A1 6/2012 Piltingsrud
2012/0167469 A1 7/2012 Maltaverne et al.
2012/0167475 A1 7/2012 Sopkowiak et al.
2012/0174487 A1 7/2012 Lambertini
2012/0180392 A1 7/2012 Lambertini
2012/0297683 A1 11/2012 Cavalcante
2012/0313387 A1 12/2012 Liang et al.
2013/0104458 A1 5/2013 Leung et al.
2013/0111819 A1 5/2013 Tremble et al.
2013/0214545 A1 8/2013 Wolf et al.
2013/0220043 A1 8/2013 Hsu et al.
2013/0256458 A1 10/2013 Kress et al.
2014/0007378 A1 1/2014 Pacini
2014/0007720 A1 1/2014 Evensen
2014/0259940 A1 9/2014 Meves et al.
2015/0114176 A1 4/2015 Bisang et al.
2015/0159429 A1 6/2015 Lund
2016/0145911 A1 5/2016 Boesel et al.
2017/0051544 A1 * 2/2017 Bertelli ..... E05C 19/002
2017/0107750 A1 4/2017 Carrier
2018/0334833 A1 * 11/2018 Brewer ..... E05B 65/0823
2019/0284855 A1 * 9/2019 Bertelli ..... E05C 19/002
2020/0131832 A1 4/2020 Bernhagen et al.

FOREIGN PATENT DOCUMENTS

DE 4210753 A1 * 10/1993 ..... E05D 11/0027
DE 20316561 U1 1/2004
DE 102007002650 A1 7/2008
DE 102009007686 A1 4/2010
DE 102010000158 A1 9/2010
EP 0740041 A1 10/1996
EP 1092829 A2 4/2001
EP 1241311 A2 9/2002
EP 1505242 A1 2/2005
EP 2735677 A1 5/2014

(56) References Cited

FOREIGN PATENT DOCUMENTS

| | | | |
|---|---|---|---|
| FR | 2572145 | A1 | 4/1986 |
| GB | 1065055 | A | 4/1967 |
| GB | 2410058 | A | 7/2005 |
| GB | 2475507 | A | 5/2011 |
| GB | 2520340 | A | 5/2015 |
| WO | WO1999046464 | A2 | 9/1999 |
| WO | WO2009072839 | A1 | 6/2009 |
| WO | WO2009153562 | A1 | 12/2009 |

* cited by examiner

WINDOW OPENING CONTROL SYSTEMS AND METHODS

CROSS-REFERENCE TO RELATED APPLICATION

This application claims priority to U.S. Provisional Application No. 62/448,615, filed Jan. 20, 2017, which is herein incorporated by reference in its entirety.

TECHNICAL FIELD

Various aspects of the instant disclosure relate to security systems, safety systems, and hardware for use in fenestration products. In some specific examples, the disclosure concerns a system that enables window sashes of a fenestration system to be partially opened without sacrificing security features and helping to avoid accidental falls from said fenestration system.

BACKGROUND

A number of fenestration units, such as windows, have one or more movable panels, also described as vent panels. In some window fenestration units, one of the window sashes is movable while another window sash is stationary or is otherwise secured against movement. For example, in some units, a lower window sash is moveable relative to an upper, stationary window sash. In some other fenestration units, multiple window sashes can move relative to the window frame and each other. For example, the lower window sash and the upper window sash can be movable relative to one another.

Security features in fenestration systems like these continue to be of great interest. Although many conventional designs incorporate the use of security features, such as locks, these security features must be disengaged in order to move the window sashes. Thus, users must sacrifice security if they want to open one or more window sashes of a fenestration unit. What's more, while the window sashes of conventional systems can be relocked upon being closed, the possibility exists that a user may forget to lock a window sash after closing it. Accordingly, there exists a need for systems that automatically reengage otherwise disabled security features after use. The opportunity for innovation and improvement in any of these areas remain and is the focus of various examples of WINDOW OPENING CONTROL SYSTEMS AND METHODS provided by this disclosure.

Safety features in fenestration systems are also of great interest. Many conventional designs incorporate the use of devices to limit the opening of the fenestration, however, these designs to not allow for egress in the event of an emergency. Accordingly, there exists a need to limit the opening of a fenestration system, while selectively allowing full opening of the system to allow for egress in the event of an emergency. There also exists a need for systems that automatically reengage otherwise disabled safety features once the fenestration has been opened (such as for emergency egress).

SUMMARY

According to one example, ("Example 1"), a fenestration system includes a frame, a first window sash movable relative to the frame, and a toggle assembly including a toggle housing, a toggle, and a biasing member. The toggle assembly is transitionable between an engaged state and a disengaged state, wherein when transitioned to the engaged state the toggle assembly operates to obstruct the first window sash from being opened beyond a designated threshold position relative to the frame, and wherein when transitioned to the disengaged state the first window sash is free to be opened beyond the designated threshold position such that upon opening the first window sash beyond the designated threshold position the toggle assembly is primed to automatically transition to the engaged state upon closing the first window sash.

According to another example, ("Example 2") further to Example 1, the toggle is configured to engage the first window sash in the engaged state to prevent the first window sash from moving beyond the designated threshold position.

According to another example, ("Example 3") further to Examples 1 to 2, the toggle is configured to engage a portion of the frame in the engaged state to prevent the first window sash from moving beyond the designated threshold position.

According to another example, ("Example 4") further to Examples 1 to 3, when configured in the disengaged state the toggle housing obstructs the toggle from preventing the first window sash from moving beyond the designated threshold position.

According to another example, ("Example 5") further to Examples 1 to 4, the toggle is operable to simultaneously rotate and translate relative to the toggle housing when the toggle assembly is transitioned between the engaged and disengaged states.

According to another example, ("Example 6") further to Examples 1 to 5, the toggle assembly is configured to automatically transition to the engaged state without requiring a user to manipulate the toggle independently of opening the first window sash beyond the designated threshold position.

According to another example, ("Example 7") further to Examples 1 to 6, the toggle further comprises a portion that is configured to engage the first window sash as the first window sash is opened beyond the designated threshold position such that the toggle assembly is primed to automatically transition to the engaged state upon closing the first window sash.

According to another example, ("Example 8") further to Examples 1 to 8, upon opening the first window sash beyond the designated threshold position the toggle assembly is primed to automatically transition to the engaged state upon closing the first window sash beyond the designated threshold position.

According to another example, ("Example 9") further to Examples 1 to 8, the fenestration system further comprises a second window sash movable relative to the first window sash, wherein when transitioned to the engaged state the toggle assembly operates to prevent the first and second window sashes from moving in excess of a designated amount relative to one another, and wherein when transitioned to the disengaged state the first and second window sashes are free to move in excess of the designated amount relative to one another.

According to another example, ("Example 10") further to Example 9, when transitioned to the engaged state, the first and second window sashes are movable relative to one another up to the designated amount, wherein the designated amount includes at least a partial opening of one or more of the first and second window sashes.

According to another example, ("Example 11") further to Examples 9 to 10, the toggle further comprises a portion that is configured to engage one of the first and second window sashes as the first and second window sashes are moved in excess of the designated amount to prime the toggle assembly to automatically transition to the engaged state.

According to another example, ("Example 12") further to Examples 1 to 11, when transitioned to the engaged state the first window sash is movable within the frame such that the first window sash can be at least partially opened.

According to another example, ("Example 13") a toggle assembly includes a toggle housing, a toggle coupled to the toggle housing and configured to rotate and translate relative to the toggle housing such that the toggle is transitionable between an engaged stated and disengaged stated, and a biasing member coupled to the toggle and to the toggle housing, the biasing member exerting a force on the toggle and the toggle housing, wherein when configured in the engaged state the toggle engages a portion of the toggle housing which operates to retain the toggle in the engaged state, and wherein when transitioning from the engaged state to the disengaged state the biasing member induces the toggle to rotate and translate relative to the toggle housing.

According to another example, ("Example 14") further to Example 13, the toggle is coupled to the toggle housing such that a translation of the toggle in a first direction relative to the toggle housing operates to disengage the toggle from the portion of the toggle housing with which it is engaged in the engaged state such that the toggle is operable to automatically transition to the disengaged state.

According to another example, ("Example 15") a method of controlling a window sash moveable within a frame in a fenestration system comprises positioning a toggle assembly on the fenestration system, the toggle assembly being transitionable between an engaged state and a disengaged state, configuring the toggle assembly in the engaged state such that the window sash is obstructed from being opened in excess of a designated amount, and transitioning the toggle assembly to the disengaged state such that the window sash can be opened in excess of the designated amount and such that upon opening the first window sash in excess of the designated amount the toggle assembly is primed to automatically transition to the engaged state upon closing the window sash.

According to another example, ("Example 16") further to Example 15, when obstructed from being opened in excess of a designated amount the first window sash can be at least partially opened.

According to another example, ("Example 17") further to Examples 15 to 16, the toggle assembly includes a toggle housing and a toggle coupled to the toggle housing such that the toggle can be translated and rotated relative to the toggle housing.

According to another example, ("Example 18") further to Examples 15 to 17, transitioning the toggle assembly to the disengaged state includes translating and rotating the toggle relative to the toggle housing such that a first portion of the toggle is captured by the toggle housing.

According to another example, ("Example 19") further to Example 18, the toggle housing includes a flange and wherein transitioning the toggle assembly to the disengaged state includes translating and rotating the toggle relative to the toggle housing such that the flange engages the first portion of the toggle.

According to another example, ("Example 20") further to Examples 15 to 19, upon opening the first window sash in excess of the designated amount the toggle assembly is primed to automatically transition to the engaged state upon closing the window sash to a position where the window sash is opened less than the designated amount.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

The control systems according to the disclosed examples can be employed in a variety of fenestration units, including sashed window systems, for example. The control systems provide a variety of novel features, including improved usability of the fenestration unit without compromising security or safety, sleek design, minimal parts, and automatic reengagement of security and safety features, as well as others.

Figure 1:
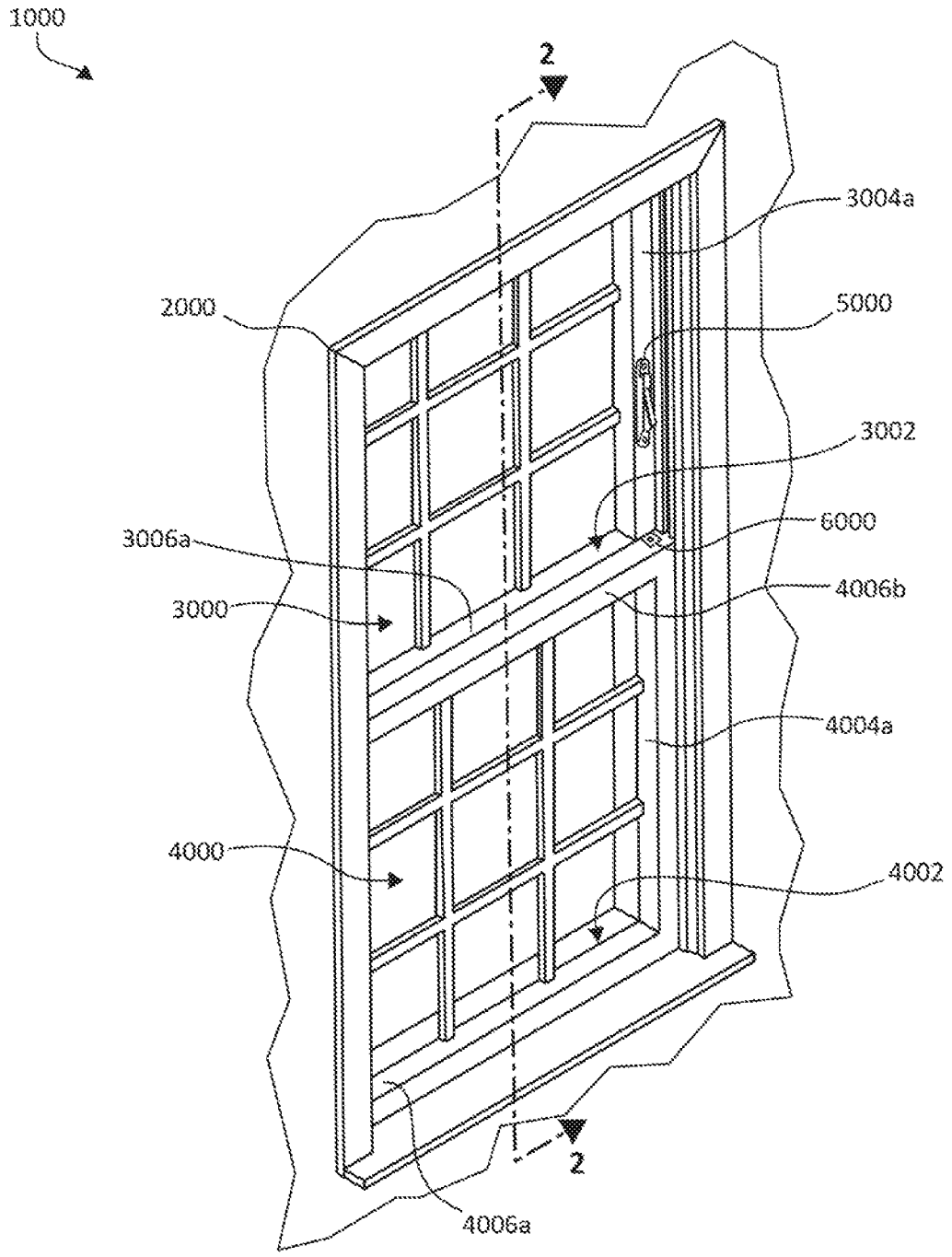
FIG. 1 is a schematic view of a fenestration assembly, according to some examples.

FIG. 1 is a schematic view of a fenestration assembly 1000 including a frame 2000, a first or upper window sash 3000, a second or lower window sash 4000, a toggle assembly 5000, and a strike plate 6000, according to some examples. The first widow sash 3000, often termed the upper widow sash is situated above the second window sash 4000, often termed the lower window sash. In some examples, the second or lower window sash 4000 is a moveable window sash. In some examples, the first or upper window sash 3000 is stationary or is otherwise not a movable window sash. In some other examples, like the lower window sash 4000, the upper window sash 3000 is also movable.

In some examples, the upper window sash 3000 includes a frame 3002. In some examples, the frame 3002 includes a plurality of vertical members, such as vertical members 3004*a* and 3004*b* (3004*b* is blocked from view in FIG. 1 by frame 2000), and a plurality of horizontal members, such as a lower horizontal member 3006*a* and an upper horizontal member 3006*b* (3006*b* is blocked from view in FIG. 1 by frame 2000). Likewise, the lower window sash 4000 includes a frame 4002. In some examples, the frame 4002 includes a plurality of vertical members, such as vertical members 4004*a* and 4004*b* (4004*b* is blocked from view in FIG. 1 by frame 2000), and a plurality of horizontal members, such as a lower horizontal member 4006*a* and an upper horizontal member 4006*b*. Although the examples below are provided with reference to a fenestration system involving window sashes, it should be understood that these features are equally applicable to other fenestration systems, such as casement window and sliding door fenestration systems, for example.

Figure 2:
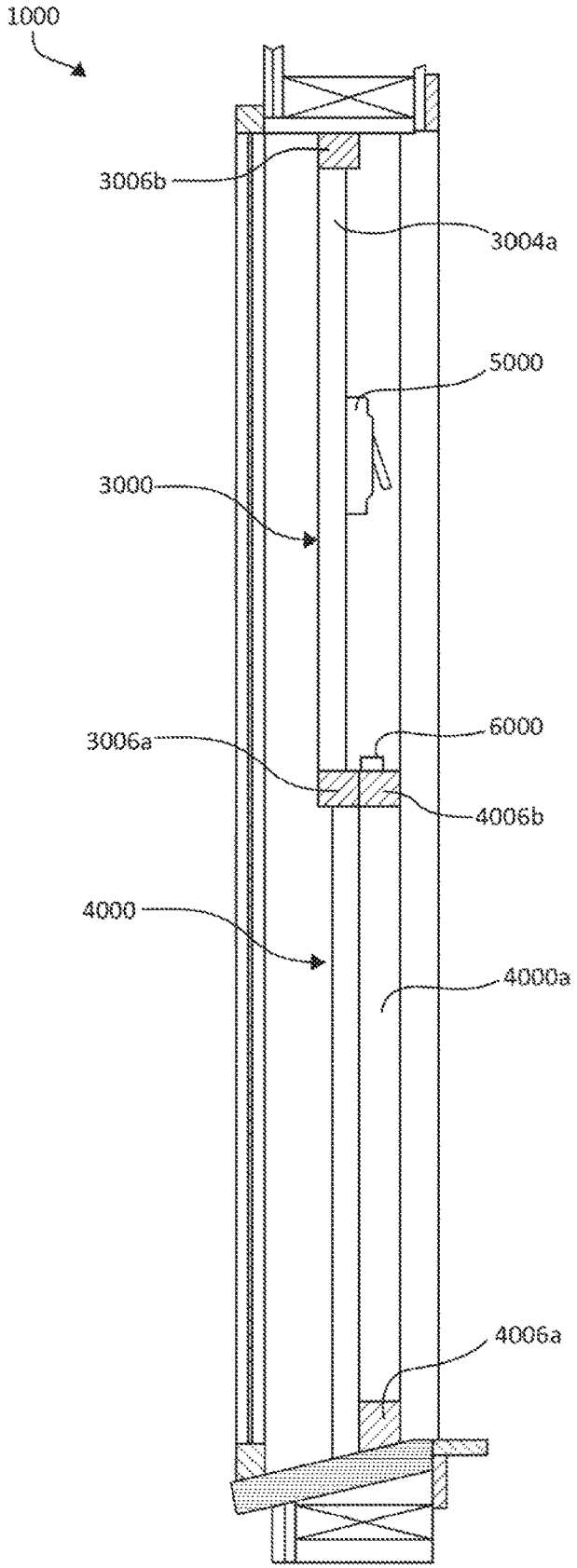
FIG. 2 is a cross-sectional view of a fenestration assembly taken along line 2-2 of FIG. 1, according to some examples.

FIG. 2 is a cross-sectional view taken along line 2-2 of the fenestration assembly 1000 illustrated in FIG. 1, according to some examples. As illustrated, the toggle assembly 5000 is coupled to the frame 3002 of the upper window sash 3000. While the toggle assembly 5000 is illustrated as being coupled to the vertical member 3004*a*, it will be appreciated that the toggle assembly 5000 may be coupled to any member of the fame 3002. Alternatively or additionally, a toggle assembly 5000 may be coupled to any member of frame 4002 of the lower window sash 4000. Alternatively or additionally, a toggle assembly 5000 may be coupled to frame 2000.

In some examples, a strike plate 6000 is coupled to the fenestration assembly 1000. As illustrated in the accompanying figures, the strike plate 6000 is coupled to the upper horizontal member 4006*b* of the lower window sash 4000. In some examples, the strike plate 6000 is aligned with the toggle assembly 5000 such that sufficient movement of the upper and lower window sashes 3000 and 4000 (as discussed in greater detail below) results in one or more physical engagements between the strike plate 6000 and the toggle assembly 5000. For example, as discussed in greater detail below, the lower window sash 4000 may be raised (and the upper window sash 3000 may be lowered) until the strike plate 6000 contacts or otherwise engages the toggle assembly 5000.

In some examples, when the strike plate 6000 engages the toggle 5200 of the toggle assembly 5000 the upper and lower window sashes 3000 and 4000 are prevented from being further opened relative to one another. Thus, while the fenestration system discussed herein permits the window sashes a designated degree of opening, it does so without compromising security or safety. In other words, the toggle assembly 5000 and the strike plate 6000 of the fenestration system 1000 permit the window sashes to be opened relative to one another while providing control over the degree to which those sashes may be opened.

In some examples, as discussed in detail below, the toggle assembly 5000 is defeatable such that the lower window sash 4000 may be fully opened (or such that the upper window sash 3000 may be fully lowered, or such that the upper and lower window sashes 3000 and 4000 may be moved beyond a designated threshold position relative to one another). Even so, in some examples, the fenestration system 1000 of the present disclosure operates to automatically prime the toggle assembly 5000 for automatic reengagement after it is defeated. For example, as discussed in greater detail below, if the upper or lower window sash 3000 or 4000 is opened beyond a designated threshold, the toggle assembly 5000 is primed for reengagement once the upper and lower window sashes 3000 and 4000 are closed (or closed to the extent that they are moved back to a position wherein the toggle assembly is free to reengage).

Figure 3:
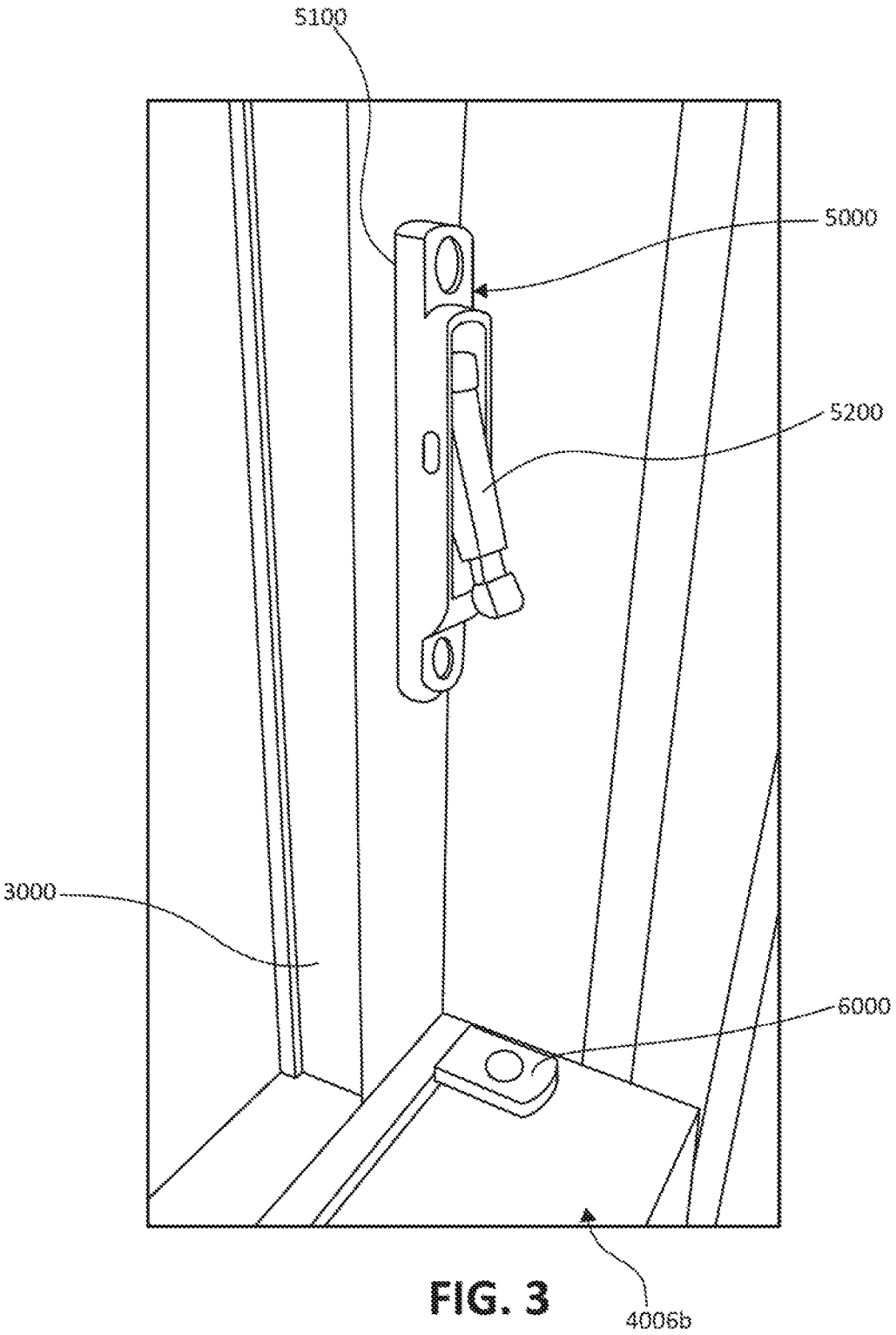
FIG. 3 is a detailed view of a toggle assembly mounted to a window sash of a fenestration assembly, according to some examples.

FIG. 3 is a perspective view illustrating the alignment and relative positioning of the toggle assembly 5000 and the strike plate 6000. In some examples, the strike plate 6000 is coupled to the upper horizontal member 4006*b* of the lower window sash 4000 such that it is aligned with the toggle assembly 5000, which is coupled to a vertical member 3006*a* of the upper window sash 3000. The illustrated alignment of the strike plate 6000 with the toggle assembly 5000 ensures that as the lower window sash 4000 is raised relative to the upper window sash 3000 (or as the upper window sash 3000 is lowered relative to the lower window sash 4000), the toggle 5200 of the toggle assembly 5000 is poised to contact the strike plate 6000 to obstruct further relative movement or translation between the upper and lower window sashes 3000 and 4000. In some examples, a contact between the toggle assembly 5000 and the strike plate 6000 operates to prevent further raising of the lower window sash 4000 or lowering of the upper window sash 3000. However, as discussed in greater detail below, the toggle assembly 5000 is defeatable to provide for further raising of the lower window sash 4000 or lowering of the upper window sash 3000.

Figure 4:
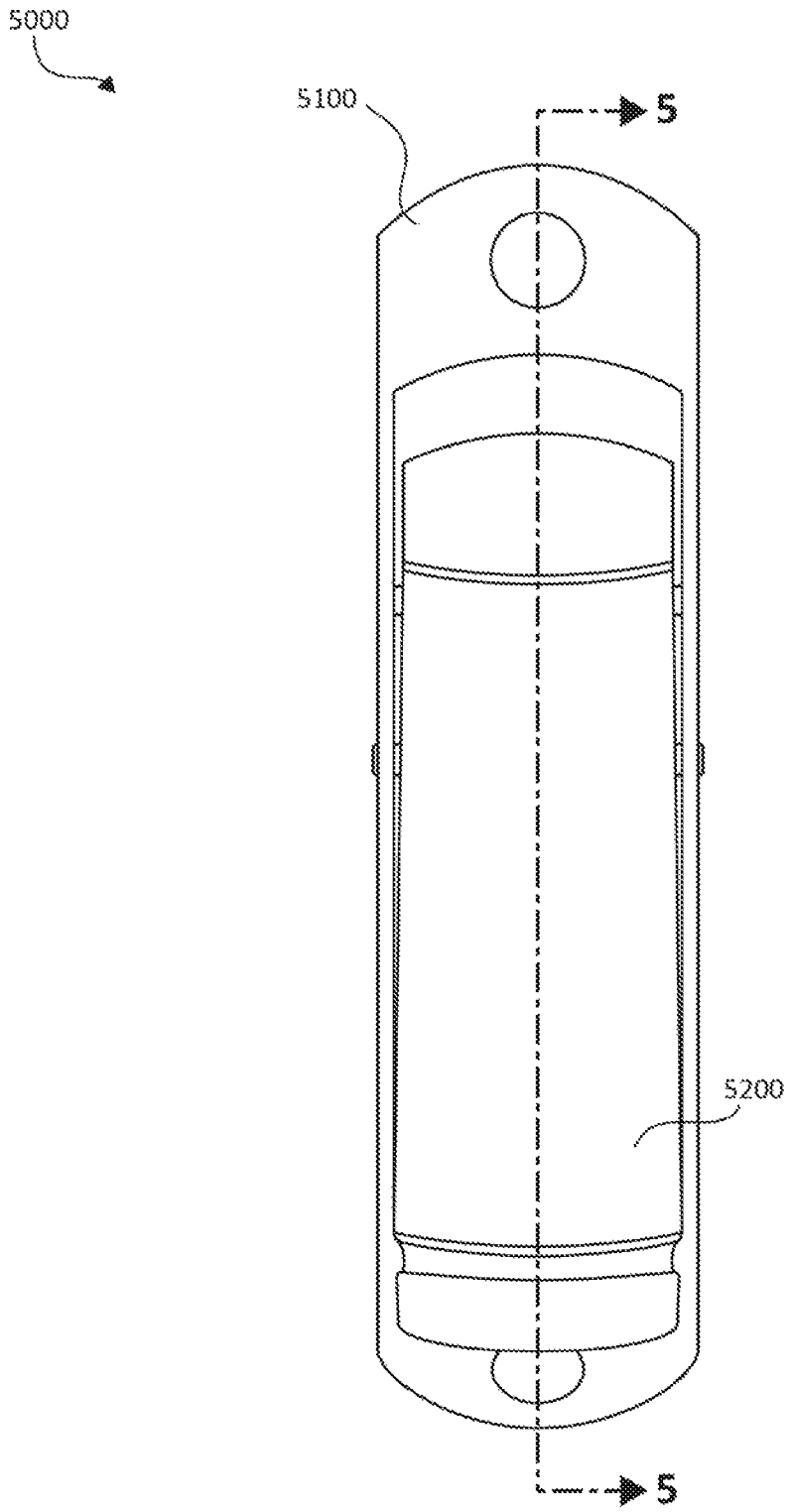
FIG. 4 is a top view of a toggle assembly, according to some examples.
Figure 5:
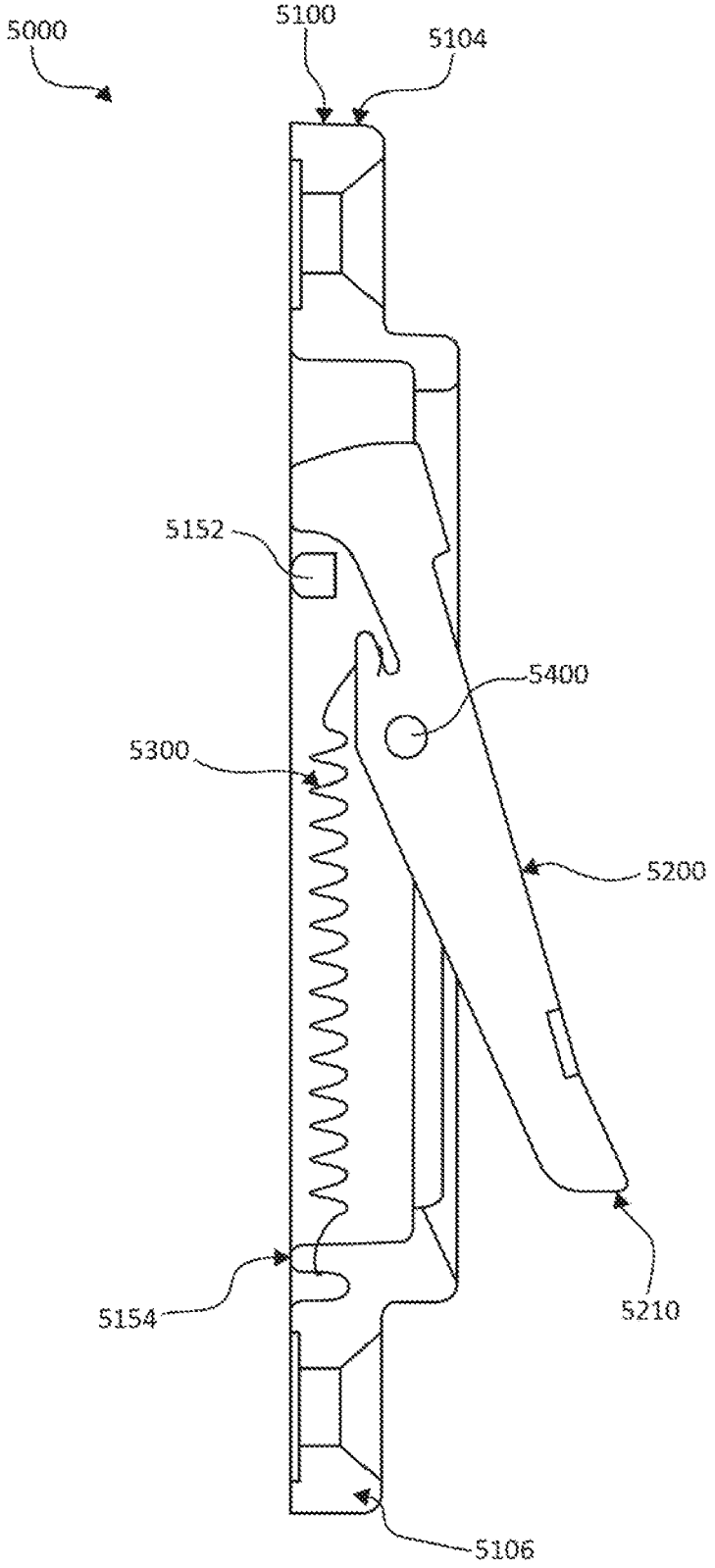
FIG. 5 is cross-sectional view of a toggle assembly taken along line 5-5 of FIG. 4, according to some examples.
Figure 6:
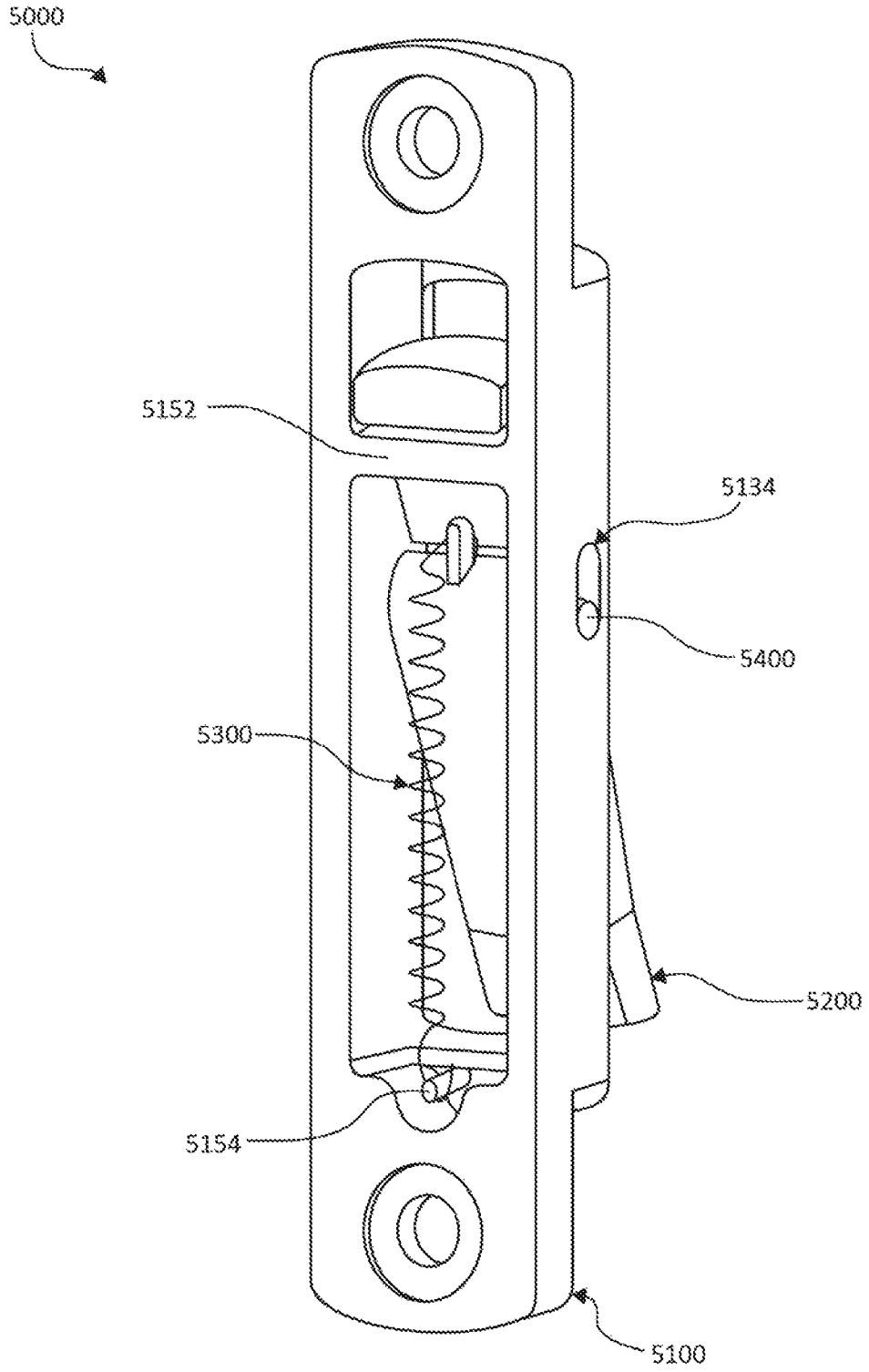
FIG. 6 is a rear perspective view of a toggle assembly, according to some examples.

Turning now to FIGS. 4 to 6, an example toggle assembly 5000 is illustrated. FIG. 4 is a front view of the toggle assembly 5000. FIG. 5 is a cross-sectional view of the toggle assembly 5000 taken along line 5-5 in FIG. 4. FIG. 6 is a rear perspective view of the toggle assembly 5000. In some examples, the toggle assembly includes a toggle housing 5100, a toggle 5200, one or more biasing members 5300, and one or more retaining pins 5400. In some examples, as explained in greater detail below, the toggle 5200 is coupled to the toggle housing 5100 such that the toggle 5200 can rotate and translate relative to the toggle housing 5100. In some examples, the biasing member 5300 operates to influence the toggle 5200 to translate and rotate relative to the toggle housing 5100, as discussed below. Additionally, in some examples, the retaining pin 5400 operate to couple the toggle 5200 to the toggle housing 5100. In some examples, the toggle 5200 is coupled to the toggle housing 5100 such that the toggle 5200 is free to rotate and translate relative to the toggle housing 5100.

Turning now to FIGS. 7 to 10, an example toggle housing 5100 is illustrated. The toggle housing includes a body 5102. In some examples, the body 5102 includes a first end portion 5104 and a second end portion 5106, a first side 5108 and a second side 5110, a top 5112 and a bottom 5114. In some embodiments, the body 5102 is generally rectangularly shaped. However, it will be appreciated that the body 5102 can be of any suitable size or shape without departing from the spirit or scope of the present disclosure. In some examples, the first and second end portions 5104 and 5106 include one or more apertures. For example, as illustrated, first end portion 5104 includes aperture 5118 and second end portion 5106 includes aperture 5120. In some examples, apertures 5118 and 5120 accommodate one or more fasteners for coupling the toggle housing 5100 to one or more components of the fenestration system 1000, such as the upper or lower window sashes 3000 and 4000 or frame 2000.

In some examples, the body 5102 further includes an intermediate portion 5116 situated between the first end portion 5104 and the second end portion 5016. In some examples, the intermediate portion 5116 includes a recess 5122. In some examples, the recess 5122 is sized to accommodate the toggle 5200 as described in greater detail below. In some examples, the recess 5122 is formed in the top 5112 of the body 5102. In some examples, the recess 5122 is defined between a first side wall 5124, a second side wall 5126, a first end wall 5128, and a second end wall 5130. In some examples, the first and second side walls 5124 and 5126 extend along the longitudinal length of the body 5102, while the first and second end walls 5128 and 5130 extend across the body 5102 and are transverse to the first and second side walls 5124 and 5126.

In some examples, the recess 5122 extends from the top 5112 to the bottom 5114. That is, in some examples, the recess 5122 is an aperture extending through the body 5102 of the toggle housing 5100. In some examples, the first and second end walls 5128 and 5130 traverse the body 5102 from the first side wall 5124 to the second side wall 5126 and are longitudinally offset from each other by the first and second side walls 5124 and 5126. In some examples, the second end wall 5130 includes a flange 5132. In some examples, the flange 5132 is formed as a protrusion in the second end wall 5130, and extends into the recess 5122. In some examples, the flange 5132 operates to deflect and retain the toggle 5200 in a disengaged position, as explained further below.

In some examples, one or more apertures 5134 are formed in the intermediate portion 5116 of the body 5102. In some examples, each aperture 5134 is configured to receive and retain the retaining pin 5400. In some examples, the apertures 5134 are formed in one or more of the first and second side walls 5124 and 5126 of the body 5102. In some examples, the apertures 5134 are slotted such that they have a longitudinal length L and a width W, wherein the longitudinal length L is greater than the width W. These slotted apertures 5134 have a first end 5136 and a second end 5138. In some examples, the slotted apertures 5134 provide the retaining pin 5400 multiple degrees of freedom to both rotate about its axis and translate along the longitudinal length of the slotted apertures 5134.

In some examples, apertures 5134 extend through the side walls 5124 and 5126 of the body 5102 such that they form an opening from an outside surface of the body 5102 through to the recess 5122. In some other examples, the apertures 5134 are formed on one or more of inside surfaces 5140 and 5142 of the body 5102 but do not extend entirely through the side walls 5124 and 5126 of the body 5102. That is, in these examples, apertures 5134 are indentations in the inside surfaces 5140 and 5142 of the body 5102 in that the apertures do not extend to an outside surface of the body 5102. Like the apertures 5134 described above, in some examples, these indentations are slotted such that they have a longitudinal length L that is greater than their width W, which permits the retaining pin 5400 freedom to both rotate about its axis and translate along the longitudinal length of the slotted indentations.

Figure 8:
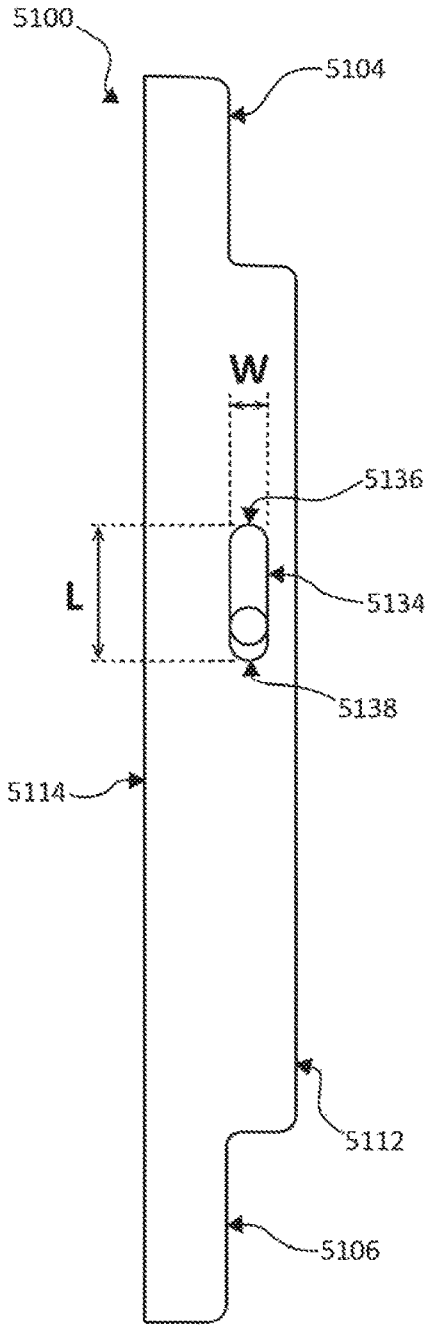
FIG. 8 is a side view of a toggle housing, according to some examples.

In some examples, the intermediate portion 5116 protrudes above a top surface of the first and second end portions 5104 and 5106 as illustrated in FIG. 8. In some examples, the top surface of the intermediate portion 5116 is laterally offset an amount sufficient to provide the recess 5122 enough depth to adequately accommodate the toggle 5200 therein. As shown, the toggle 5200 is received within the recess 5122 such that a portion of the toggle 5200, when disengaged, is situated at or below the top surface of the intermediate portion 5116.

Figure 7:
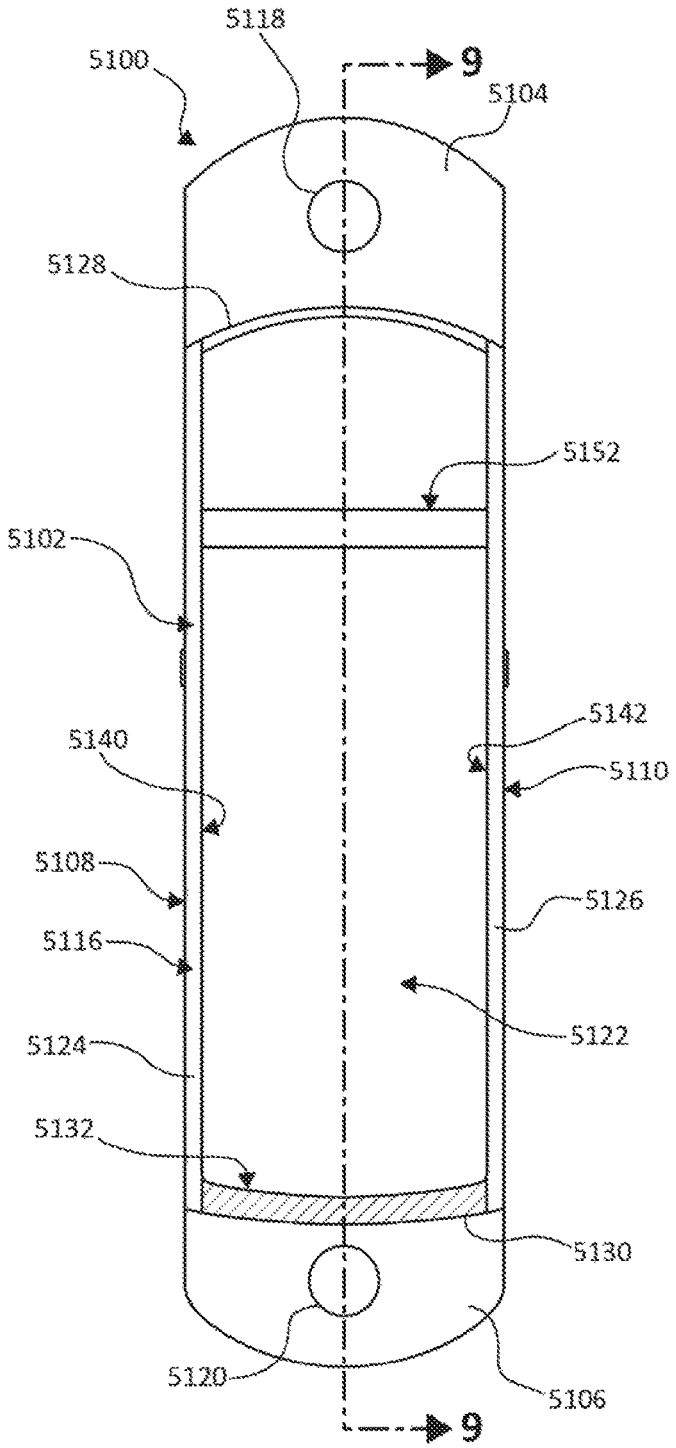
FIG. 7 is a top view of a toggle housing, according to some examples.
Figure 9:
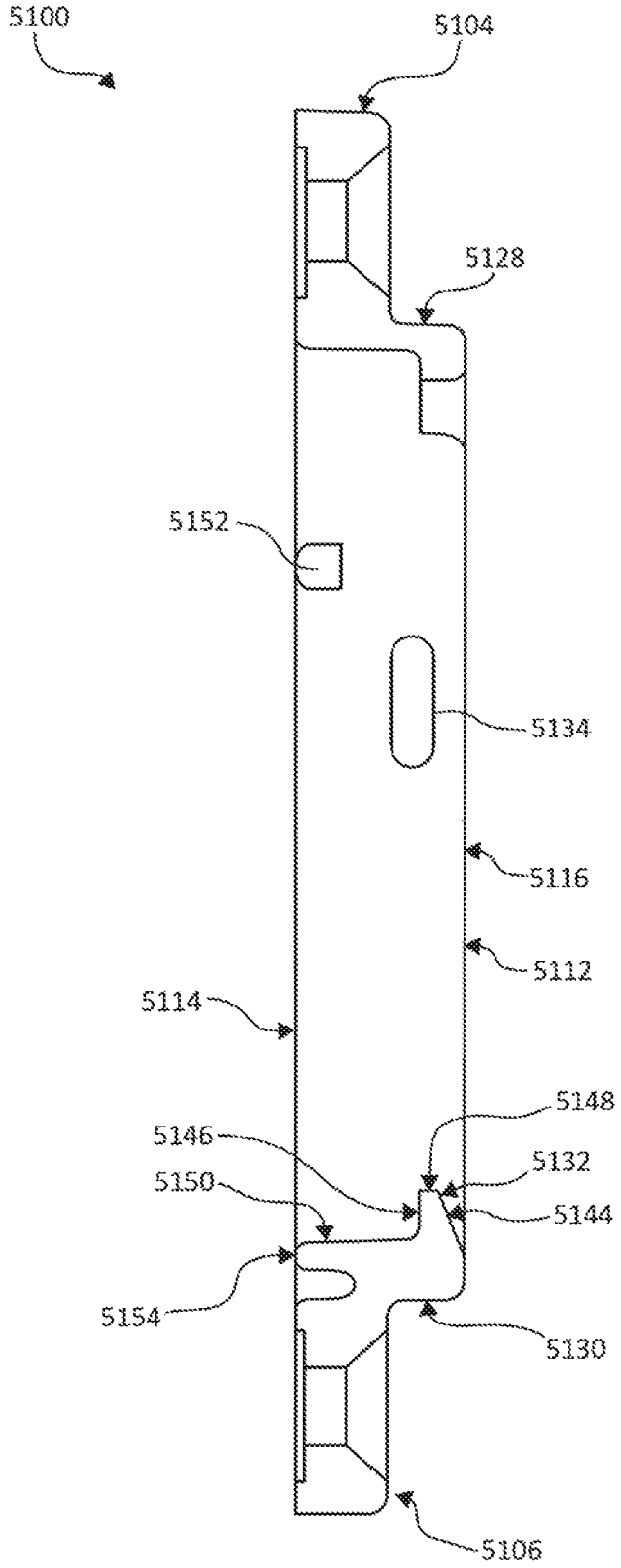
FIG. 9 is a cross-sectional view of a toggle housing taken along line 9-9 of FIG. 7.
Figure 10:
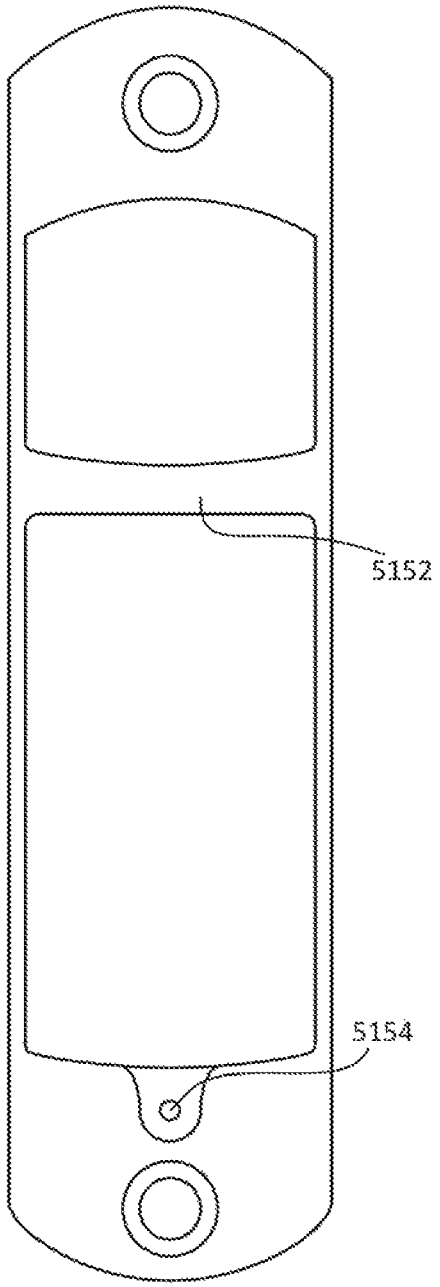
FIG. 10 is a back view of a toggle housing, according to some examples.

Referring now to FIG. 9, a cross-sectional view taken along line 9-9 of FIG. 7 is shown. In some examples, the flange 5132 includes a ramp portion 5144, a retention face or surface 5146, and a free end 5148 situated between the ramp portion 5144 and the retention face 5146. In some examples, the flange 5132 protrudes into recess 5122 and extends from the second end wall 5130 toward the first end wall 5128 such that the flange 5132 extends into the recess 5122. In some examples, the flange 5132 extends laterally between the first side wall 5124 to the second side wall 5126. In some examples, the ramp portion 5144 is a surface that angles away from the top 5112 of the body 5102 toward the bottom 5114 of the body 5102 as the surface of the ramp portion 5144 is traversed from the second end wall 5130 toward the first end wall 5128. In some examples, the ramp portion 5144 terminates in the free end 5148, as illustrated. In some examples, the retention face 5146 extends between the second end wall 5130 and the free end 5148 of the ramp portion 5144. In some examples, the ramp portion 5144 terminates into the retention face 5146. That is, in some examples, the flange 5132 does not include a free end 5148.

In some examples, the retention face 5146 is oriented such that it obstructs the second end portion 5210 from rotating away from the bottom 5114 of the toggle housing 5100. In some such examples, the retention face 5146 extends away from to the second end wall 5130 toward the free end 5148. In some examples, the retention face 5146 is generally parallel with the surface of the ramp portion 5144. In some other examples, the retention face 5146 extends substantially perpendicularly away from to the second end wall 5130 toward the free end 5148. As discussed in greater detail below, the flange 5132 operates to retain the toggle in a disengaged position. Thus, in some examples, the flange 5132 extends into the recess 5122 an amount sufficient to obstruct toggle 5200 from rotating away from the bottom 5114 of the toggle housing 5100, as discussed below.

In some examples, the toggle housing 5100 includes one or more transverse struts extending between the side walls 5124 and 5126 of the body 5102. For example, referring back to FIG. 7, a strut 5152 extends between the side walls 5124 and 5126. In some examples, the strut 5152 is situated proximate the bottom 5114 of the toggle housing 5100. In some examples, the strut 5152 is situated more proximate the first end portion 5104 than the second end portion 5106. Generally, the strut 5152 is positioned within the recess 5122 such that it obstructs the toggle 5200 from over rotation or over translation within the toggle housing 5100. Thus, it will be appreciated that the strut may be positioned anywhere within the recess 5122 provided it operates to interact with the toggle 5200 in a manner that obstructs the toggle 5200 from over rotating or over translating within the toggle housing 5100. In some examples, the strut 5152 alternatively or additionally provides a degree of structural support to the toggle housing 5100.

In various examples, the toggle housing 5100 and/or the toggle 5200 may be made of a metallic material such as steel, stainless steel, aluminum, zinc, or any other metallic material. The toggle housing 5100 and/or the toggle 5200 may be machined, cast, forged, or formed from any other suitable manufacturing process. In various embodiments, the toggle housing 5100 and/or the toggle 5200 could be made of a suitable composite material or a plastic. In various embodiments, the toggle housing 5100 and/or the toggle 5200 may be formed from a suitable manufacturing process such as die casting, injection molding, machining, or any other material specific and suitable method. For example, the toggle housing 5100 and/or the toggle 5200 may be die cast zinc.

Figure 11:
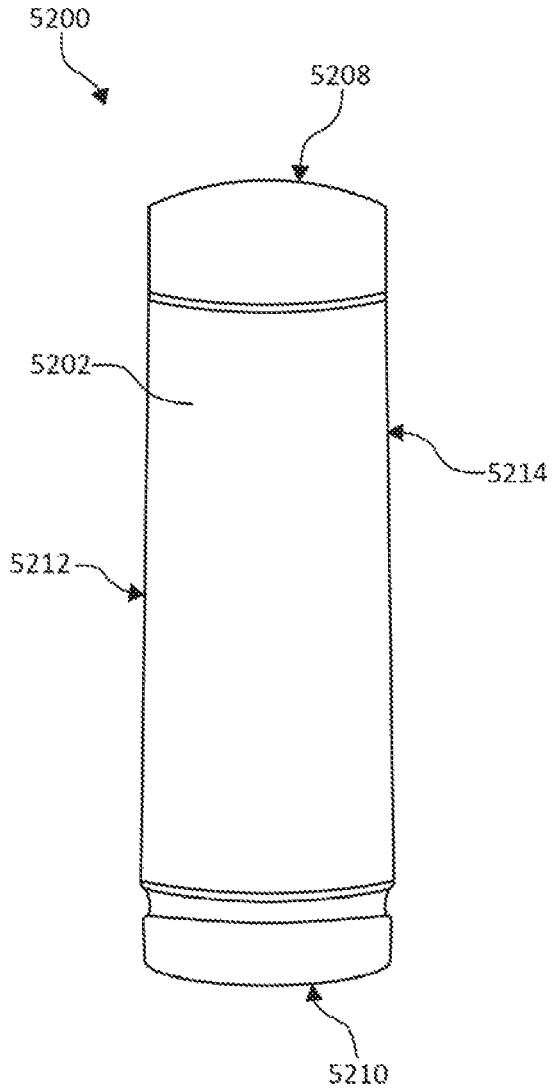
FIG. 11 is a top view of a toggle, according to some examples.
Figure 12:
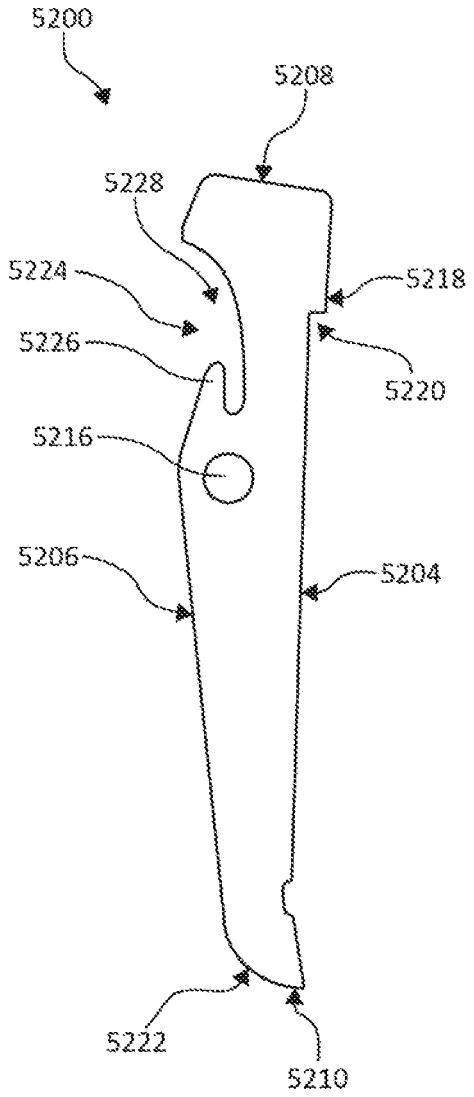
FIG. 12 is a side view of a toggle, according to some examples.
Figure 13:
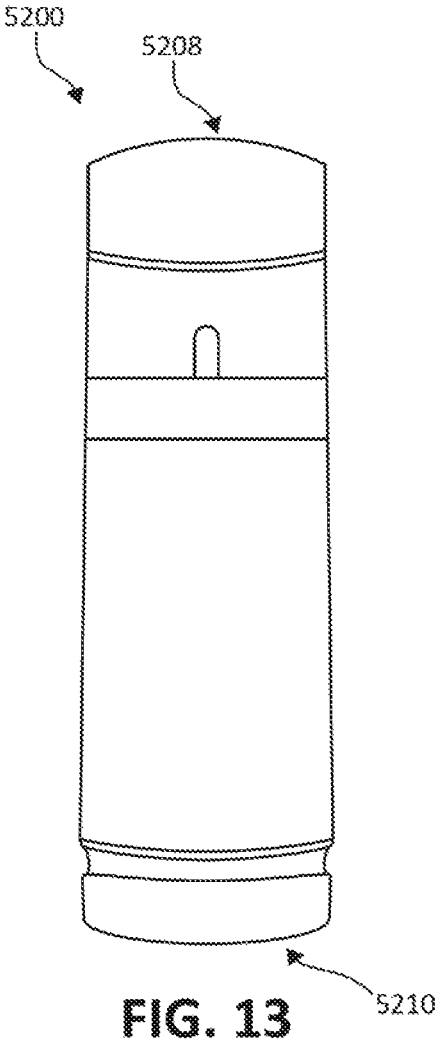
FIG. 13 is a back view of a toggle, according to some examples.

FIGS. 11 to 13 illustrate a toggle 5200 of the toggle assembly 5000. In some examples, the toggle 5200 includes a body 5202 having a top side or surface 5204, a bottom side or surface 5206, a first end portion 5208, a second end portion 5210, a first side 5212, and a second side 5214. In some examples, the top side 5204 includes a priming feature 5218 that operates to prime the toggle assembly 5000 for reengagement. In some examples, the priming feature 5218 is formed in the top surface 5204 proximate to or in the first end portion 5208 of the toggle 5200. In some examples, the priming feature 5218 is formed as a protrusion in the top surface 5204 of the toggle 5200. In some examples, the priming feature 5218 includes a reaction surface 5220 that extends between a top surface of the priming feature 5218 and the top surface 5204 of the toggle 5200. In some examples, the reaction surface 5220 is perpendicular to the top surface 5204 of the toggle 5200.

As explained in greater detail below, in some examples, the priming feature 5218 operates to prime the toggle assembly 5000 for reengagement once the window sashes of the fenestration system have been moved to a designated relative position (or have otherwise moved beyond or in excess of a designated threshold). Specifically, in some examples, once primed, the toggle assembly 5000 is configured to automatically reengage once the upper and lower window sashes 3000 and 4000 have been repositioned such that the toggle assembly 5000 is free to reengage (e.g., no component of the fenestration system is positioned such that it obstructs the toggle 5200 from rotating to an engaged position).

In some examples, in addition to contacting the strike plate 6000 to limit the relative movement of the window sashes, the second end portion 5210 of the toggle 5200 also operates to retain the toggle 5200 in the toggle housing 5100 such that the toggle assembly 5000 is disengaged. In some examples, the second end portion 5210 includes a reaction surface 5222 that connects the bottom surface 5206 with the top side 5204 at the second end portion 5210. As shown in FIG. 12, the reaction surface 5222 is a curved surface. However, it will be appreciated that the reaction surface 5222 need not be curved. For example, the reaction surface 5222 may be a linear surface that extends between the top surface 5204 and the bottom surface 5206 that is angled relative to the top and bottom surfaces 5204 and 5206 to form a ramp. For example, the reaction surface 5222 may be angled in the range of thirty (30) degrees to sixty (60) degrees relative to the top surface 5204. It will be appreciated, however, that the reaction surface 5222 may be angled at any sufficient angle or, alternatively, not angled at all (e.g., the toggle 5200 may include a blunt end at its second end portion 5210). In some examples, the reaction surface 5222 contacts and slides along the flange 5132 of the toggle housing 5100 as the second end portion 5210 of the toggle 5200 is rotated into the toggle housing 5100, as described below.

In some examples, the toggle 5200 further includes one or more retaining pin housings. For example, as illustrated in FIG. 12 the toggle 5200 includes a retaining pin housing 5216. In some examples, the retaining pin housing 5216 is an aperture extending through the toggle 5200 from the first side 5212 of the toggle 5200 to the second side 5214 of the toggle 5200. In some other examples, the toggle 5200 includes a plurality of retaining housings wherein a retaining pin housing 5216 is formed as a recess or cavity in each of the first and second sides 5212 and 5214 of the toggle 5200. In some examples, a retaining pin 5400 is positioned within (or otherwise received by) the retaining pin housing 5216. That is, in some examples, the retaining pin housing 5216 is configured to receive a retaining pin 5400 therein. In some examples, the retaining pins 5400 operate to retain and constrain the toggle 5200 within the toggle housing 5100.

In some examples, the toggle 5200 further includes a biasing member engagement feature 5224. In some examples, the biasing member engagement feature 5224 is configured couple the toggle 5200 with the biasing member 5300. In some examples, the biasing member engagement feature 5224 includes a nose 5226. In some examples, the nose 5226 is formed as a protrusion in the bottom surface 5206 of the toggle 5200. In some such examples, a recess 5228 is formed in the bottom side of the toggle 5200 and the nose 5226 extends into the recess 5228 such that the nose 5226 extends generally toward the first end portion 5208 of the toggle 5200.

In some examples, the biasing member engagement feature 5224 is offset relative to the retaining pin housing 5216 such that the biasing member engagement feature 5224 is offset relative to the longitudinal axis of the retaining pins 5400 received within the retaining pin housing 5216 of the toggle 5200. As will be appreciated, such an offset provides for the creation of a moment about the longitudinal axis of the retaining pin 5400. Specifically, as explained in more detail below, the biasing member 5300 exerts a force on the biasing member engagement feature 5224 that induces a moment about the longitudinal axis of the retaining pin 5400 that influences the toggle 5200 to rotate about the longitudinal axis of the retaining pin 5400. In some examples, the biasing member engagement feature 5224 is longitudinally offset relative to the retaining pin housing 5216. For example, the biasing member engagement feature 5224 is positioned more proximate the first end portion 5208 than is the retaining pin housing 5216. In some examples, the biasing member engagement feature 5224 is alternatively or additionally offset relative to the retaining pin housing 5216 such that the biasing member engagement feature 5224 is positioned more proximate the bottom surface 5206 than is the retaining pin housing 5216.

Figure 16:
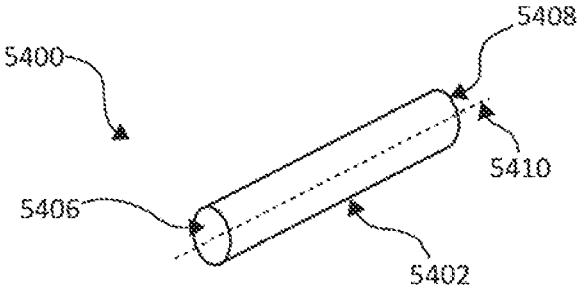
FIG. 16 is a perspective view of a retaining pin, according to some examples.

Turning now to FIG. 16, in some examples, the toggle assembly 5000 includes one or more retaining pins 5400. In some examples, each retaining pin 5400 is cylindrically shaped and includes a longitudinal axis. For example, as illustrated in FIG. 16, the retaining pin 5400 is a member having a body 5402, a first end portion 5404, a second end portion 5406, and an intermediate portion 5408. In some examples, the retaining pin 5400 has a longitudinal axis 5410.

It will be appreciated, however, that the retaining pin 5400 may be of any other suitable shape without departing from the spirit or scope of the present disclosure. For example, the first and second end portions 5404 and 5406 of the retaining pin 5400 may be cylindrically shaped while the intermediate portion 5408 is some other suitable shape. Likewise, in some examples, one of the first and second end portions 5404 and 5406 may be of some other shape. In some such embodiments, one of the first and second end portions 5404 and 5406 may be oblong or rectangularly shaped to prevent relative motion between that end portion and the feature within which it is attached. Such a configuration constrains the system to rotate and/or translate about the opposing end portion. In some other such embodiments, one of the first and second end portions 5404 and 5406 may be a cammed feature, which facilitates translation of the toggle 5200 relative to the toggle housing 5100 as the toggle 5200 is rotated relative to the toggle housing 5100.

Referring back now to FIGS. 4 to 6, the toggle assembly 5000 includes a toggle housing 5100, a toggle 5200, a biasing member 5300, and one or more retaining pins 5400. In some examples, a retaining pin 5400 is received within the retaining pin housing 5216. In some examples, the retaining pin 5400 is press fit into the retaining pin housing 5216 such that the retaining pin 5400 is fully constrained relative to the toggle 5200. In other words, in these examples, the retaining pin is constrained in all degrees of freedom relative to the toggle 5200. In some other examples, the retaining pin 5400 is constrained against any significant lateral or longitudinal movement relative to the toggle 5200. In some such examples, the retaining pin 5400 is free to rotate relative to the toggle 5200. In some other examples, one or more of the retaining pins 5400 is formed as an integral part of the toggle 5200.

As illustrated, the toggle 5200 is coupled to the toggle housing 5100 such that the toggle 5200 is at least partially received within the toggle housing 5100. In some examples, the retaining pins 5400 received within the retaining pin housing 5216 of the toggle 5200 are also received with in the apertures 5134 of the toggle housing 5100. In some examples, once received within the apertures 5134 of the toggle housing 5100, the retaining pins 5400 are additionally independently constrained by the apertures 5134 of the toggle housing 5100. That is, the retaining pins 5400 are independently constrained by both the apertures 5134 and the retaining pin housings 5216.

In some examples, the apertures 5134 are configured to permit the retaining pins 5400 to rotate and translate longitudinally along the longitudinal length of the toggle housing 5100 within the apertures 5134. Thus, in some examples, the motion of the toggle 5200 relative to the toggle housing 5100 is at least partially governed by the manner in which the retaining pins 5400 are constrained by the toggle housing 5100.

In some examples, as mentioned above, the biasing member 5300 exerts a force on the toggle 5200 that influences the toggle 5200 to rotate and translate relative to the toggle housing 5100. As illustrated in FIGS. 5 and 6, the biasing member 5300 is coupled to both the toggle 5200 and the toggle housing 5100. Specifically, in some examples, the biasing member 5300 is coupled to the biasing member engagement feature 5224 of the toggle 5200 and to the biasing member engagement feature 5154 of the toggle housing 5100.

In some examples, when coupled to the toggle housing 5100 and the toggle 5200, the biasing member 5300 exerts a force on the toggle 5200 and the toggle housing 5100 that influences the toggle 5200 and the toggle housing 5100 to move relative to one another. Generally, however, the toggle housing 5100 is coupled to and fully constrained relative to a frame of a window sash, as explained above. Accordingly, the force exerted on the toggle 5200 by the biasing member 5300 causes the toggle 5200 to rotate and translate relative to the toggle housing 5100.

As mentioned above, in some examples, the toggle 5200 is at least free to translate and rotate relative to the toggle housing 5100 in accordance with the manner in which the retaining pin 5400 is constrained by the toggle housing 5100. Thus, the force exerted on the toggle 5200 by the biasing member 5300 causes the toggle 5200 to rotate and translate relative to the toggle housing 5100 at least in accordance with the manner in which the retaining pins 5400 are enabled to translate and rotate relative to the toggle housing 5100.

In some examples, given the positioning of the biasing member engagement feature 5224 relative to the retaining pin housings 5216, the force exerted on the toggle by the biasing member 5300 causes the second end portion 5210 of the toggle 5200 to rotate away from the bottom 5114 of the toggle housing 5100. That is, the biasing member 5300 exerts a force on the toggle 5200 such that the second end portion 5210 of the toggle 5200 is influenced away from the bottom 5114 of the toggle housing 5100.

In some examples, the toggle 5200 is limited in the degree to which it can rotate and translate relative to the toggle housing 5100. That is, in some examples, the second end portion 5210 of the toggle 5200 is permitted to rotate only a designated number of degrees away from the bottom 5114 of the toggle housing 5100. In some examples, the toggle 5200 rotates in the range of ten (10) to sixty (60) degrees relative to the toggle housing 5100. In some examples, the toggle 5200 rotates up to ninety (90) degrees relative to the toggle housing 5100. In some examples, the toggle housing 5100 operates to limit the degree to which the toggle 5200 rotates relative to the toggle housing 5100. For example, in some instances, the toggle 5200 is free to rotate relative to the toggle housing 5100 until the toggle 5200 contacts the strut 5152. In some examples, the frame of the window sash to which the toggle assembly 5000 is mounted additionally or alternatively operates to limit the degree to which the toggle 5200 rotates relative to the toggle housing 5100. For example, in some instances, the toggle 5200 is free to rotate relative to the toggle housing 5100 until the toggle 5200 contacts the window sash to which the toggle assembly 5000 is mounted.

In some examples, the retaining pin 5400 additionally or alternatively operates to limit the degree to which the toggle 5200 rotates relative to the toggle housing 5100. For example, one or more of the toggle housing 5100, toggle 5200, or retaining pin 5400 includes a feature that operates to engage one or more of the toggle housing 5100, toggle 5200, or retaining pin 5400 to limit the degree to which the toggle 5200 rotates relative to the toggle housing 5100.

In addition, given the positioning of the biasing member engagement feature 5224 relative to the retaining pin housings 5216, the force exerted on the toggle 5200 by the biasing member 5300 causes the toggle 5200 to translate along the longitudinal length of the toggle housing 5100 toward the second end portion 5106 of the toggle housing 5100. Put differently, the biasing member 5300 exerts a force on the toggle 5200 that influences the toggle 5200 to translate along the longitudinal length of the toggle housing 5100 and toward the second end portion 5106 of the toggle housing 5100. As discussed above, in some examples, the manner in which the toggle 5200 is free to translate relative to the toggle housing 5100 is based at least in part on the manner in which the retaining pin 5400 is constrained to translate relative to the toggle housing 5100 (e.g., within apertures 5134 of the toggle housing 5100). In some examples, the retaining pins 5400 are constrained to translating within the apertures 5134 along the length L from the first end 5136 to the second end 5138 of the apertures 5134. Accordingly, in some examples, the toggle 5200 is permitted to translate toward the second end portion 5106 until the retaining pin 5400 contacts the second end 5138 of aperture 5134. Likewise, in some examples, the toggle 5200 is permitted to translate toward the first end portion 5104 until the retaining pin 5400 contacts the first end 5136 of aperture 5134.

Figure 14:
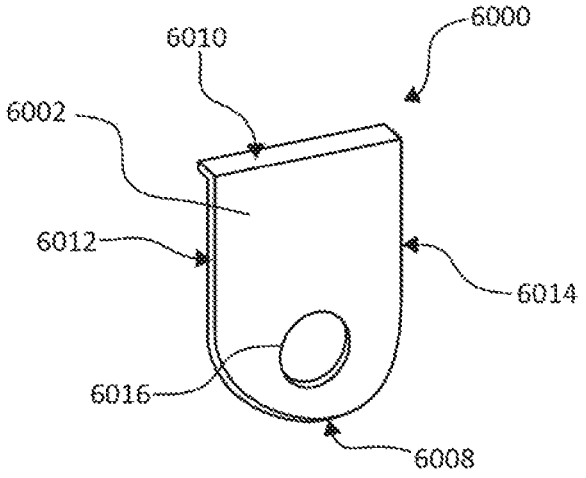
FIG. 14 is a top perspective view of a strike plate, according to some examples.
Figure 15:
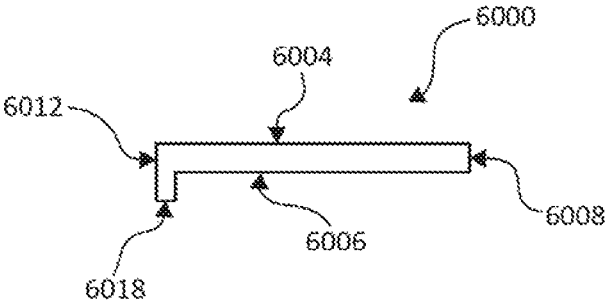
FIG. 15 is a side view of a strike plate, according to some examples.

Turning now to FIGS. 14 and 15, a strike plate 6000 is illustrated. In some examples, the strike plate 6000 has a body 6002 including a top or upper surface 6004, a bottom or lower surface 6006, a first end 6008, a second end 6010, a first side 6012, and a second side 6014. In some examples, the strike plate 6000 includes an aperture 6016 for mounting the strike plate 6000 to a window sash of the fenestration system 1000. In some examples, the strike plate 6000 is mounted to a window sash via one or more fasteners, such as one or more screws, bolts, studs, nuts, etc. In some examples, the strike plate 6000 further includes a flange 6018 extending from its bottom surface 6006 at one of its first and second ends 6008 and 6010. In some examples, the flange 6018 is a protrusion extending away from the bottom surface 6006 of the strike plate 6000. In some examples, the strike plate 6000 is integrally formed with the window sash. In some other examples, the fenestration assembly 1000 does not include a strike plate. That is, in some examples, the strike plate 6000 is not required.

As discussed above, the window sashes of the fenestration system 1000 of the present disclosure can be opened or otherwise moved relative to one another a designated degree without compromising security. For example, in conventional designs, to open one or more of the window sashes of a fenestration system, conventional locks must be disengaged. That is, in these conventional fenestration systems the security features available prohibit a window sash from being opened. Thus, operators of conventional fenestration units must sacrifice safety to open their windows. Unlike these conventional systems, the novel fenestration system 1000 of the present disclosure provides users the ability to open one or more window sashes of the fenestration system 1000 without first having to disable the security system (i.e., without sacrificing their security). It will be appreciated that the toggle assembly 5000 of the present disclosure may be utilized in combination with one or more other conventional security features, such as window locks.

Figure 17:
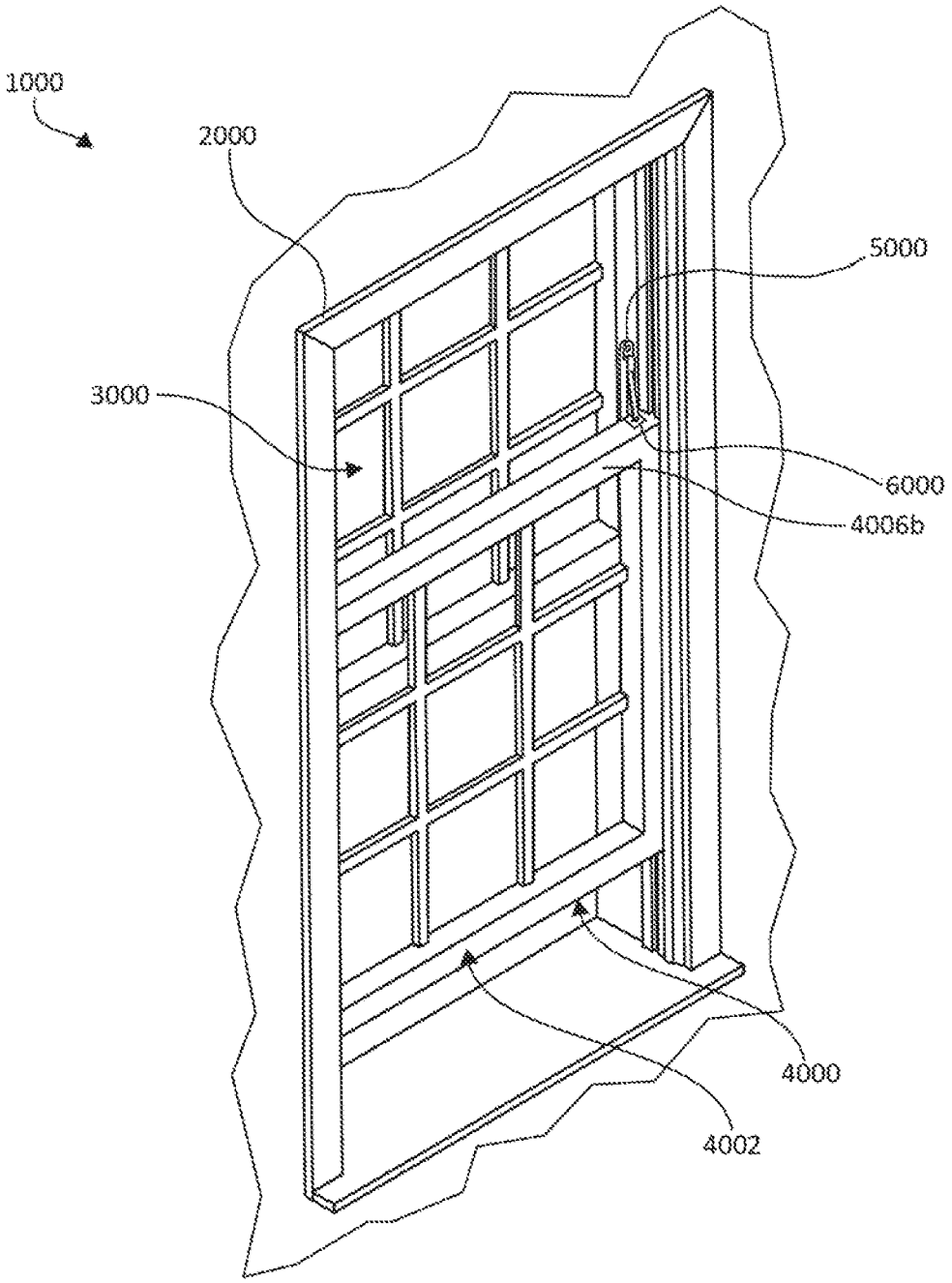
FIG. 17 is a schematic view of a fenestration assembly, according to some examples.
Figure 18:
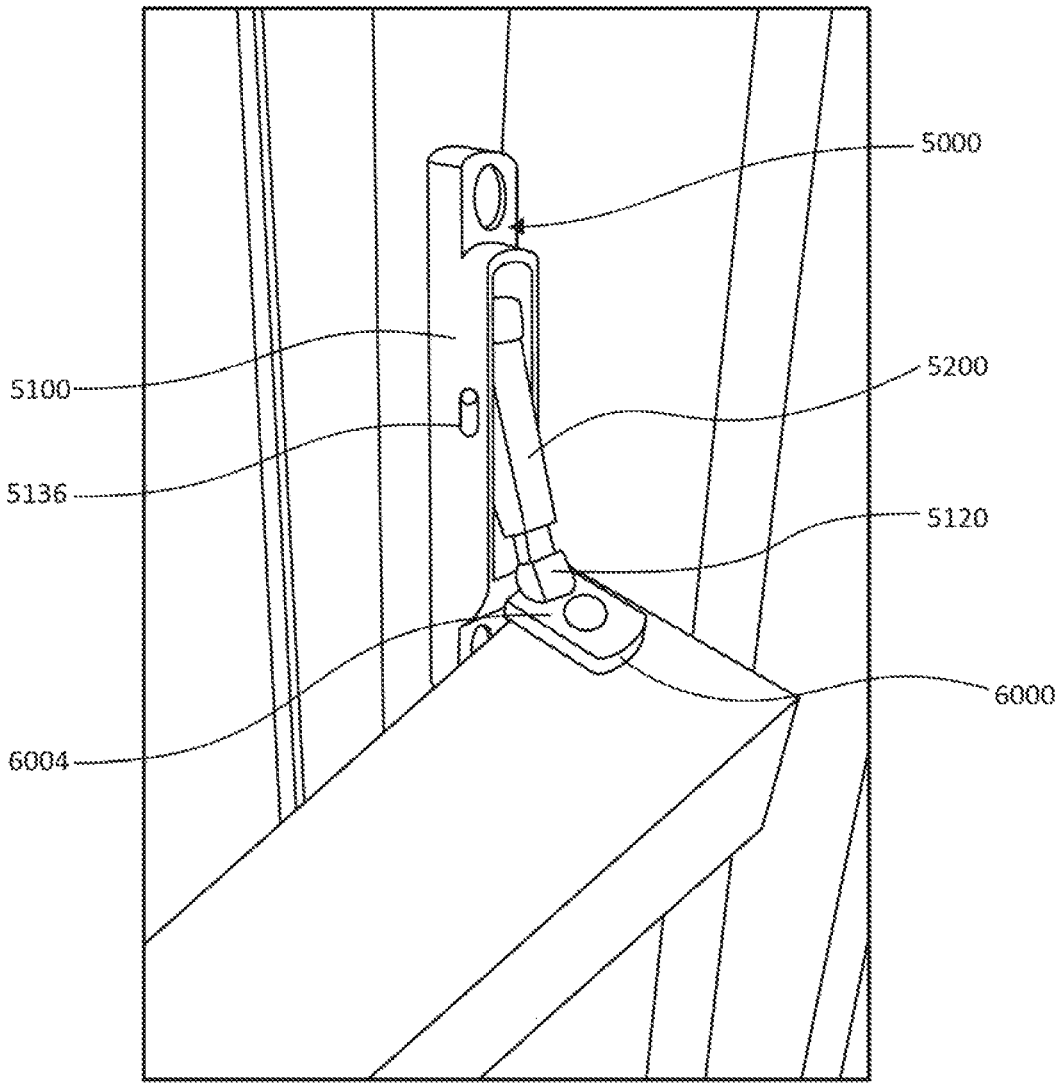
FIG. 18 is a detailed view of a toggle assembly mounted to a window sash of a fenestration assembly, according to some examples.

Turning now to FIGS. 17 and 18, the fenestration system 1000 is illustrated with the lower window sash 4000 partially opened. FIG. 18 is a detailed view illustrating the interaction between the toggle assembly 5000 and the strike plate 6000. As shown, despite the lower window sash 4000 being partially opened, the user's security is not jeopardized. Indeed, even with the lower window sash 4000 partially opened, the toggle assembly 5000 remains engaged and prepared to interact with the strike plate 6000 to prevent further opening of the lower window sash 4000 (or further lowering of the upper window sash 3000 relative to the lower window sash 4000).

In some examples, the toggle assembly 5000, when engaged, operates to obstruct a window sash from being moved past the toggle assembly 5000. In the examples illustrated in the accompanying drawings, the toggle assembly 5000 is illustrated as obstructing or otherwise preventing a lower window sash 4000 from be opened past the toggle assembly 5000. Specifically, in the illustrated examples herein, the toggle 5200 of the toggle assembly 5000 physically contacts a strike plate 6000 mounted to an upper horizontal member **4006*b* of the frame 4002 of the lower window sash 4000 and operates to prevent the lower window sash 4000 from being further opened. In other words, in the illustrated example, the toggle assembly 5000 operates in conjunction with the strike plate 6000 to obstruct or otherwise prevent further opening of the lower window sash 4000. In addition, it will be appreciated that the toggle assembly 5000 also operates to obstruct any further lowering of the upper window sash 3000 relative to the lower window sash 4000. Specifically, further lowering of the upper window sash 3000 would require the toggle assembly 5000 to move past the strike plate 6000 (and the lower window sash 4000). As the strike plate 6000 (and the upper horizontal frame member 4006*b*) is obstructing the toggle assembly from moving therepast, the upper window sash 3000** is obstructed from being further lowered.

With specific reference to FIG. 18, in some examples, when the toggle assembly 5000 physically contacts the strike plate 6000, the second end portion 5210 of the toggle 5200 contacts the upper surface 6004 of the strike plate 6000. In some examples, as the strike plate 6000 contacts the second end portion 5210 of the toggle 5200, the force exerted on the toggle 5200 by the strike plate 6000 is counteracted by the toggle assembly 5000. In some examples, as force is exerted on the toggle 5200, the toggle 5200 moves relative to toggle housing 5100. In some examples, the toggle 5200 moves in accordance with the retaining pins 5400 sliding in apertures 5134. In some examples, the retaining pin 5400 slides in aperture 5134 until it engages the first end 5136 of aperture 5134. In some examples, the retaining pin 5400 slides in aperture 5134 until the first end portion 5208 of the toggle 5200 contacts the first end wall 5128 of the toggle housing 5100. In some examples, the retaining pin 5400 slides in aperture 5134 until the biasing member 5300 prevents further movement of the toggle 5200. In some examples, a combination of two or more of these force counteracting mechanisms operate to prevent further translation of the toggle 5200 within the toggle housing 5100.

In some examples, the toggle assembly 5000, alone, may operate to prevent a window sash from being opened past the toggle assembly 5000. In other words, in some examples, implementation of a strike plate 6000 is not required. Additionally, although the illustrated examples show the toggle assembly 5000 coupled to an upper window sash 3000, in some examples, the toggle assembly 5000 may be coupled to the lower window sash 4000. In yet other examples, the toggle assembly 5000 may be incorporated into or otherwise coupled to the frame 2000 of the fenestration system. In any of these examples, the toggle assembly 5000 operates to obstruct the upper and lower window sashes 3000 and 4000 from being raised or lowered a designated threshold amount relative to one another.

While the toggle assembly 5000 operates to obstruct or otherwise prevent the upper and lower window sashes 3000 and 4000 from moving past each other a designated amount, the toggle assembly 5000 can be selectively defeated to enable further movement of the upper and lower window sashes 3000 and 4000 relative to each other. As discussed above, in some examples, the toggle 5200 is coupled to the toggle housing 5100 via one or more retaining pins 5400. Additionally, as mentioned above, the retaining pins 5400 are received within the apertures 5134 of the toggle housing 5100. In some examples, the apertures 5134 are slotted such that the retaining pins 5400 are free to rotate and translate within the apertures 5134 (and thus toggle 5200 is free to rotate and translate within the toggle housing 5100 a designated amount).

In some examples, a user may selectively disengage the toggle assembly 5000 to permit the window sashes of the fenestration system 1000 to be further moved relative to one another. That is, a user may selectively disengage the toggle assembly 5000 to raise the lower window sash 4000 beyond a threshold amount otherwise limited by an engaged toggle assembly 5000 (e.g., fully raising the lower window sash 4000). Likewise, selectively disengaging the toggle assembly 5000 may also permit lowering the upper window sash 3000 beyond a threshold amount otherwise limited by an engaged toggle assembly 5000 (e.g., fully lower the upper window sash 3000).

In some examples, the toggle assembly 5000 is disengaged when the toggle 5200 no longer obstructs relative movement of the upper and lower window sashes 3000 and 4000. In some examples, the toggle assembly 5000 is disengaged by rotating the toggle 5200 a sufficient amount such that the second end portion 5210 is retained within the toggle housing 5100. In some examples, to disengage or otherwise deactivate the toggle assembly 5000, the operator applies a force to the toggle 5200 such that the second end portion 5210 rotates toward the toggle housing 5100 and subsequently becomes retained within the toggle housing 5100. Generally, an application of a force F to the toggle 5200 proximate the second end portion 5210 will create a moment about the retaining pin housing 5216. Provided the applied force F is sufficient for the created moment to overcome the moment created by the biasing member 5300 (explained above), the toggle 5200 will rotate such that the second end portion 5210 rotates toward to the toggle housing 5100.

FIGS. 19 to 24 illustrate the rotational and translational aspects of the toggle assembly 5000 as the toggle assembly 5000 is disengaged or otherwise transitioned from an engaged (or activated) state to disengaged (or deactivated) state. FIGS. 19 to 24 are intended to illustrate one example method of disengaging the toggle assembly 5000 and should not be construed as limiting. Instead, FIGS. 19 to 24 are intended to illustrate, among other features, the movement of the toggle 5200 relative to the toggle housing 5100 as the toggle assembly 5000 is disengaged or otherwise deactivated. It will be appreciated that the toggle assembly 5000 may be disengaged or otherwise deactivated via a number of alternative methods, including alternative mechanisms, all of which are envisioned and a number of which are discussed further below.

Figure 19:
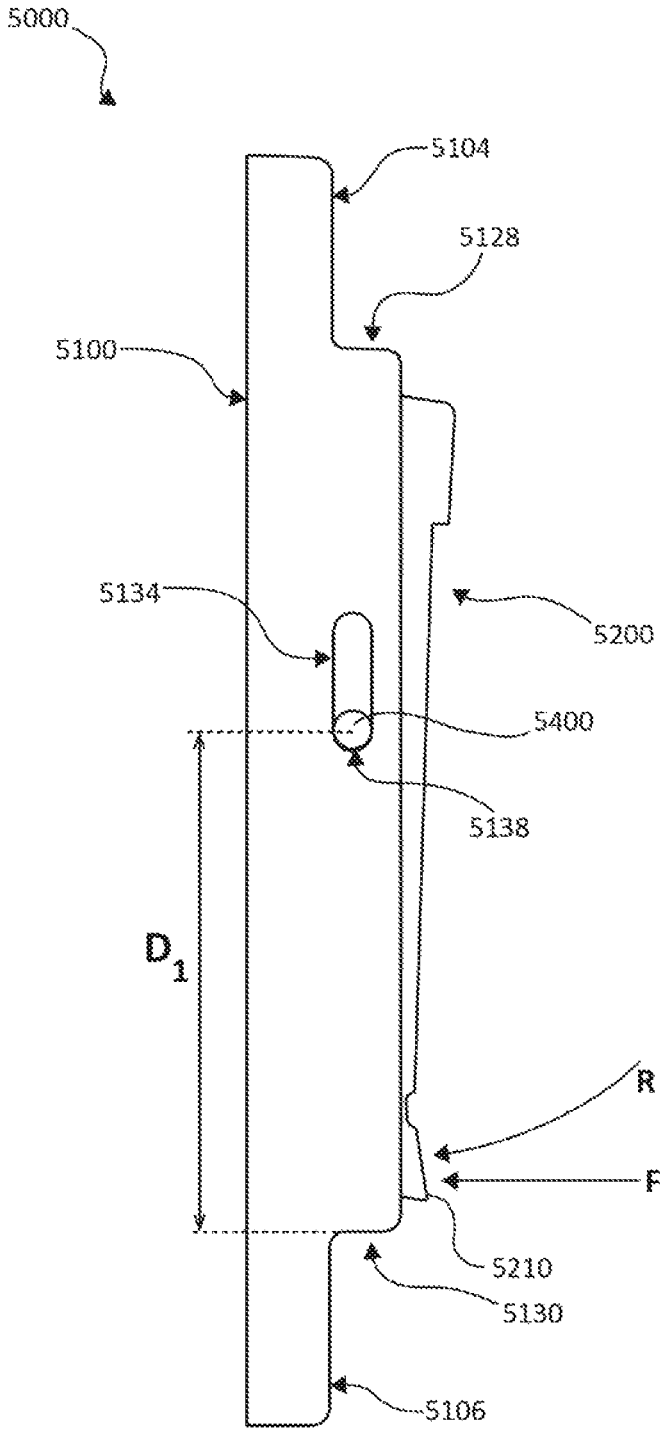
FIG. 19 is a side view of a toggle assembly, according to some examples.

In comparing FIG. 19 with FIG. 5, the effect of applying a sufficient force F to the toggle 5200 to cause the second end portion 5210 of the toggle 5200 to rotate toward the toggle housing 5100 is illustrated. Specifically, the application of a force F to the toggle 5200 in a direction toward the toggle housing 5100 and at a position along the toggle 5200 that is more proximate the second end portion 5210 than is the retaining pin housing 5216 causes the toggle 5200 to rotate in a direction R about the longitudinal axis of the retaining pin 5400. In some examples, the toggle 5200 generally maintains its longitudinal position D1 along the longitudinal length of the toggle housing 5100 as the second end portion 5210 rotates toward the toggle housing 5100.

Figure 20:
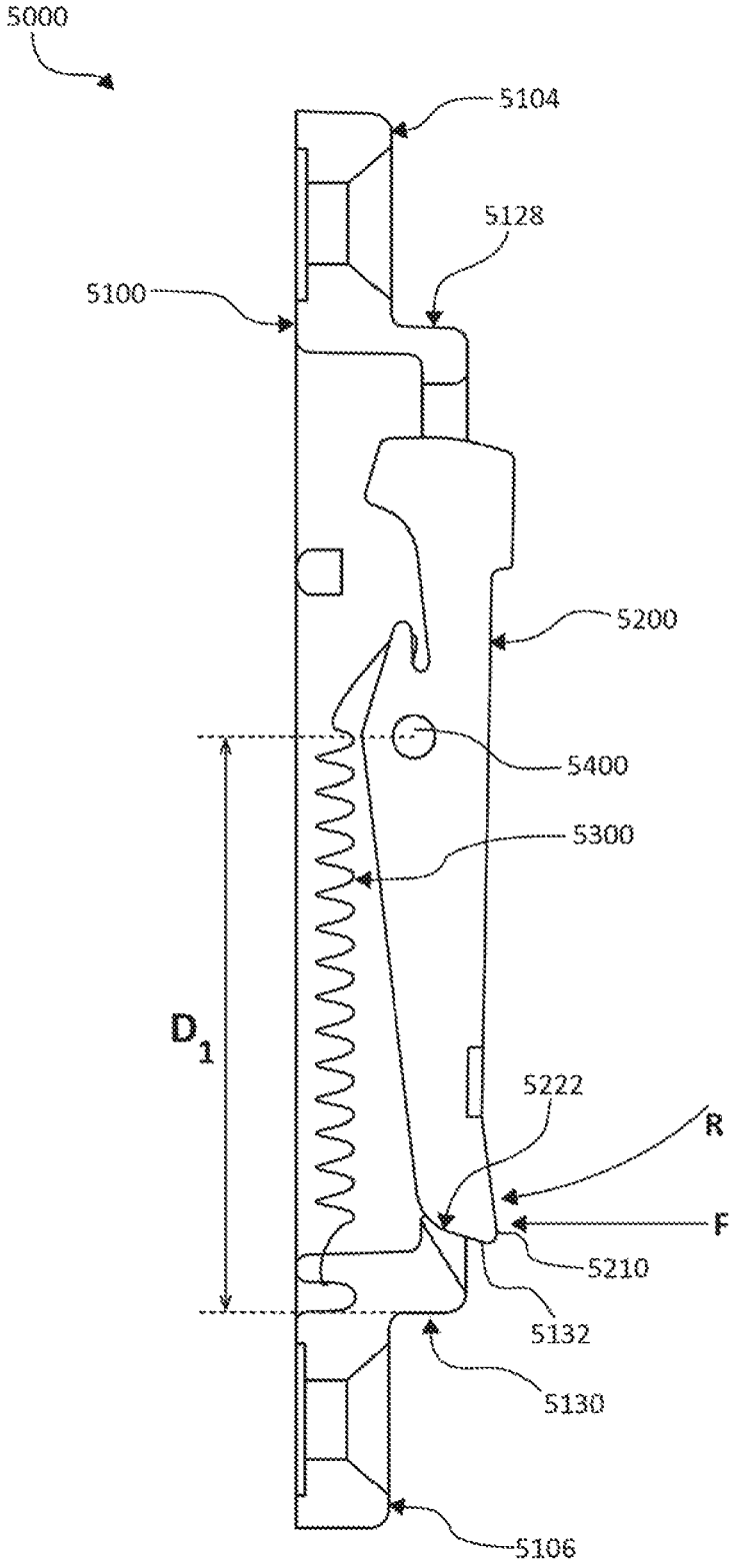
FIG. 20 is a cross-sectional view of a toggle assembly taken along line 5-5 of FIG. 4 with the toggle assembly rotated to the position illustrated in FIG. 19, according to some examples.

FIG. 20 is a cross-sectional view of the toggle assembly 5000 taken along line 5-5 of FIG. 4, but with the toggle 5200 rotated to the position illustrated in FIG. 19. As shown, the toggle 5200 is rotated to a position where the reaction surface 5222 of the toggle 5200 is proximate the flange 5132 of the toggle housing 5100.

Figure 21:
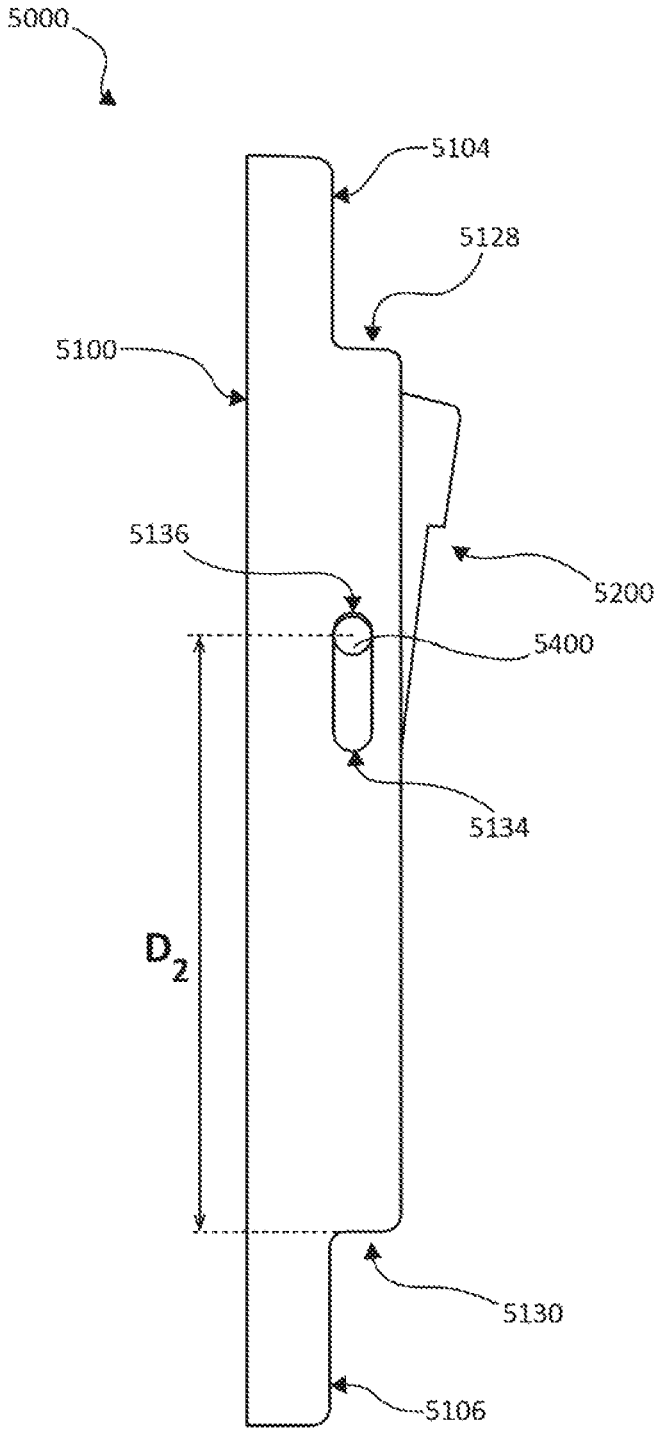
FIG. 21 is a side view of a toggle assembly, according to some examples.
Figure 22:
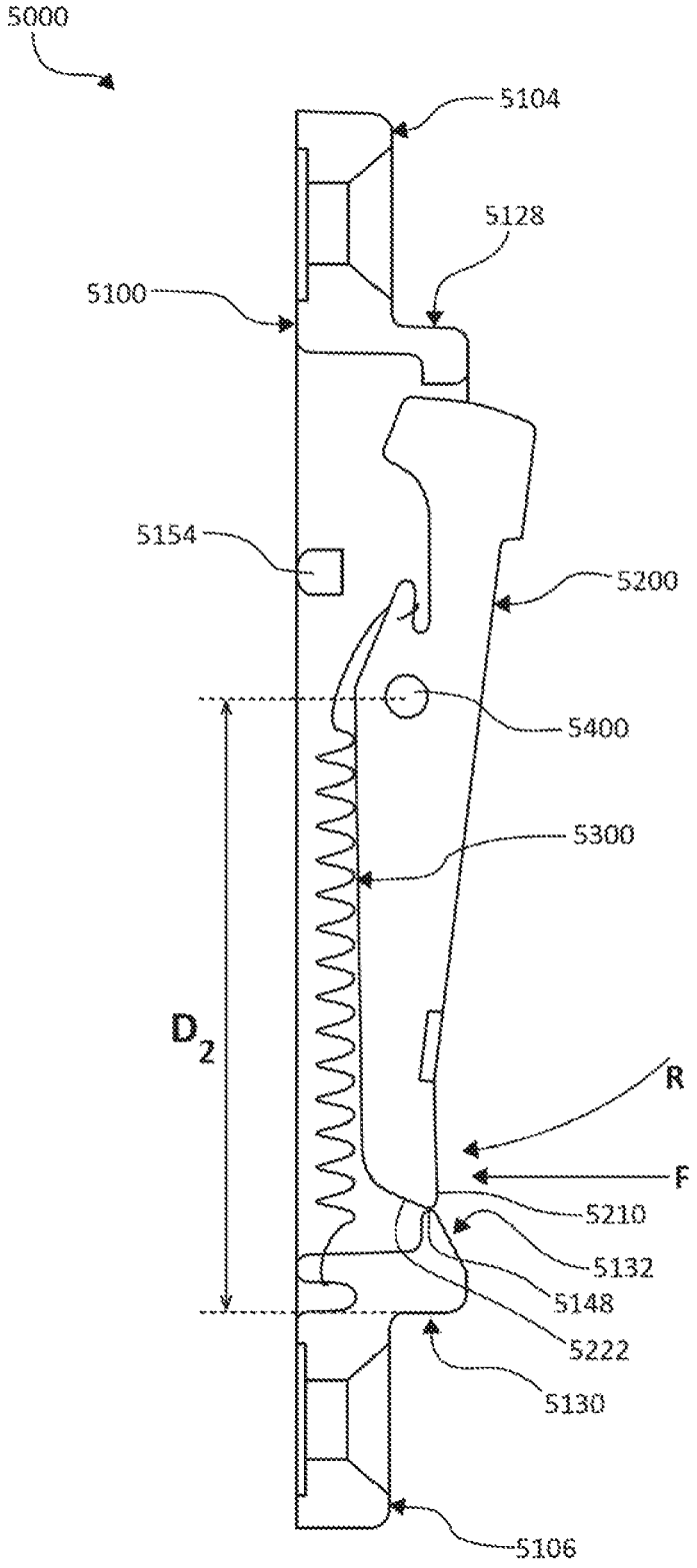
FIG. 22 is a cross-sectional view of a toggle assembly taken along line 5-5 of FIG. 4 with the toggle assembly rotated to the position illustrated in FIG. 21, according to some examples.

In comparing FIGS. 19 and 20 with FIGS. 21 and 22, the effect of further rotating the toggle 5200 in the direction R relative to the toggle housing 5100 is illustrated. Specifically, in some examples, further rotating the toggle 5200 in the direction R relative to the toggle housing 5100 causes the toggle 5200 to further rotate about the longitudinal axis of the retaining pin 5400. In addition, in some examples, this additional rotation of the toggle 5200 causes the toggle 5200 to translate along the longitudinal length of the toggle housing 5100. That is, in some examples, the toggle 5200 simultaneously translates as it rotates. In some examples, the toggle 5200 simultaneously translates as it rotates through a designated degree of rotation. That is, in some examples, as the toggle 5200 rotates through a first degree of rotation, the toggle 5200 rotates without translating, while as the toggle 5200 rotates through a second degree of rotation, the toggle 5200 simultaneously translates as it rotates.

Specifically, as illustrated in FIG. 22, the toggle 5200 has rotated and translated relative to the toggle housing 5100. Specifically, the toggle 5200 has rotated such that its second end portion 5210 is more proximate the bottom 5114 of the toggle housing 5100, and the toggle 5200 has translated to a position D2. In comparing the relative position of the toggle 5200 in FIGS. 20 and 22, it is apparent that, in position D2, the toggle 5200 has translated to a position where its second end portion 5210 is more proximate the first end portion 5104 of the toggle housing 5100 than is the second end portion 5210 of the toggle when the toggle is in position D1. In short, in some examples, transitioning from position D1 to position D2, the toggle 5200 translates away from the second end portion 5106 of the toggle housing 5100.

In some examples, the toggle 5200 translates as a result of its interaction with the toggle housing 5100. Specifically, in some examples, as the toggle 5200 rotates relative to the toggle housing 5100, the reaction surface 5222 of the toggle 5200 contacts the flange 5132. As the toggle 5200 continues to rotate, the reaction surface 5222 slides along the surface of the flange 5132. As the reaction surface 5222 slides along the surface of the flange 5132, the toggle 5200 is forced to translate. Specifically, in some examples, the flange 5132 causes a component of the force F applied to the toggle 5200 (for rotation) to be redirected in the direction of the longitudinal length of the toggle housing 5100 as would be understood by one of skill in the art. In some examples, this redirected force causes the toggle 5200 to translate. However, as explained in greater detail below, the toggle 5200 may translate as a result of another mechanism (in addition to or alternative to the flange 5132), such as a camming feature located in the toggle housing 5100 or the toggle 5200.

In some examples, as the reaction surface 5222 of the toggle 5200 contacts the flange 5132 and the toggle 5200 translates, the apertures 5134 of toggle housing 5100 constrain the toggle 5200 to translate in accordance with the translation of the retaining pins 5400 within the apertures 5134. In other words, the flange 5132 operates in accordance with the apertures 5134 to direct and constrain the motion or translation of the toggle 5200 as it is further rotated within the toggle housing 5100. In some examples, provided a force sufficient to cause toggle 5200 to rotate continues to be applied, the toggle 5200 continues to rotate and translate until the toggle 5200 has translated an amount sufficient for the end of the second end portion 5210 of the toggle 5200 to clear the free end 5148 of the flange 5132, as illustrated in FIG. 22. In some examples, the second end portion 5210 of the toggle 5200 is clear of the free end 5148 of the flange 5132 when further rotation of the toggle 5200 will not cause the toggle 5200 to further translate as a result of the toggle 5200 interacting with the flange 5132. Position D2 accords with the toggle 5200 having been rotated and translated such that the second end portion 5210 of the toggle 5200 is clear of the free end 5148 of the flange 5132.

In some examples, the differential distance between positions D1 and D2 is consistent with the extent to which flange 5132 of the toggle housing 5100 projects into the recess 5122 of the toggle housing 5100.

In some examples, once the toggle 5200 has been rotated a sufficient amount relative to the toggle housing 5100, the toggle 5200 engages one or more retaining features of the toggle housing 5100 and thereby becomes retained by the toggle housing 5100. In some examples, when retained by the toggle housing 5100, the toggle 5200 is constrained against movement relative to the toggle housing 5100. Accordingly, in some examples, when retained by the toggle housing 5100, the retaining features of the toggle housing 5100 operate to prevent the biasing member 5300 from causing the toggle 5200 to rotate or translate. Thus, in some examples, when retained by the toggle housing 5100, the toggle housing 5100 operates to obstruct the toggle 5200 from returning to its engaged state.

Figure 23:
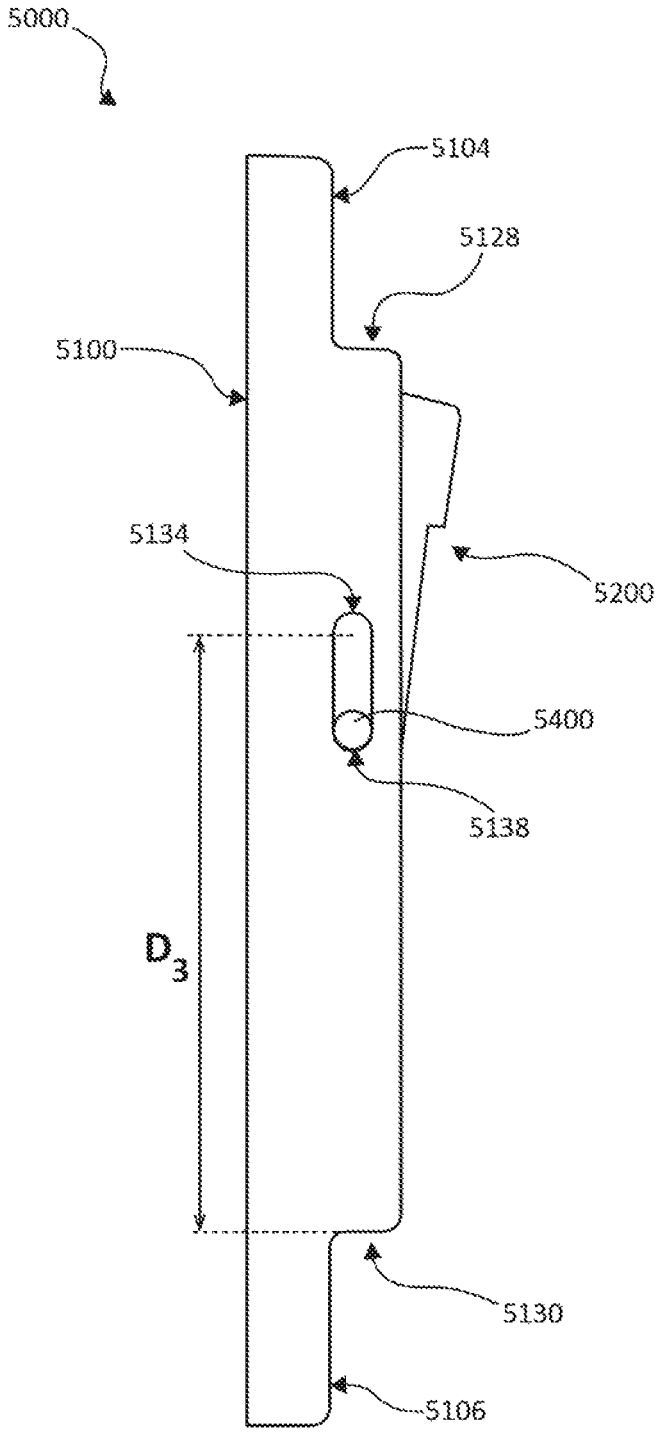
FIG. 23 is a side view of a toggle assembly, according to some examples.
Figure 24:
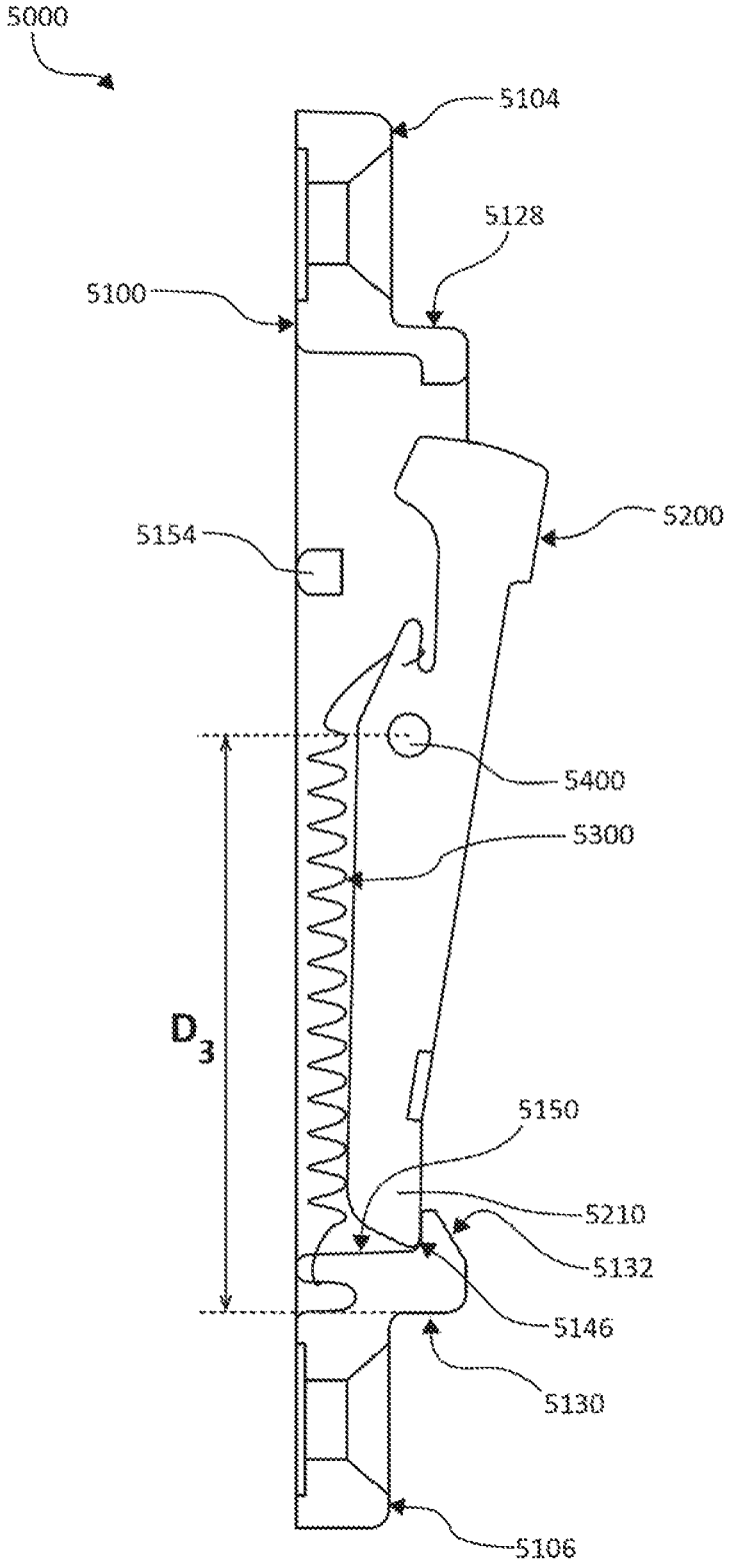
FIG. 24 is a cross-sectional view of a toggle assembly taken along line 5-5 of FIG. 4 with the toggle assembly rotated to the position illustrated in FIG. 23, according to some examples.

Turning now to FIGS. 23 and 24, the toggle assembly 5000 is illustrated in a disengaged or deactivated state. In the disengaged or deactivated state, the toggle 5200 is retained by the toggle housing 5100. As illustrated in FIG. 24 in the disengaged state, the second end portion 5210 (or a portion thereof) of the toggle 5200 is situated proximate the retention face 5146 of the toggle housing 5100. In some examples, the retention face 5146 of the toggle housing 5100 operates as an obstruction to the second end portion 5210 of the toggle 5200 rotating away from the toggle housing 5100. That is, in some examples, in the disengaged state, the flange 5132 and the retention face 5146 operate to prevent the toggle 5200 from being rotated about the longitudinal axis of the retaining pin 5400 in the opposite direction of rotational direction R.

In some examples, in transitioning to the disengaged state, the toggle 5200 is rotated relative to the toggle housing 5100 such that the top surface 5204 of the toggle 5200 clears the flange 5132. In some examples, the top surface 5204 of the toggle 5200 clears the flange 5132 when the top surface 5204 of the toggle 5200 is more proximate the bottom 5114 of the toggle housing 5100 than is the retention surface 5146 of the flange 5132. In some examples, when the top surface 5204 of the toggle 5200 clears the flange 5132, the biasing member 5300 causes the toggle 5200 to translate along the longitudinal length of the toggle housing 5100 toward to the second end wall 5130. Thus, in some examples, the biasing member 5300 contributes to the retention of the toggle 5200 by the toggle housing 5100.

For example, as discussed above, the biasing member 5300 exerts a force on the toggle 5200 that influences the toggle 5200 to translate toward the second end wall 5130. In some examples, when the top surface 5204 of the toggle 5200 sufficiently clears the flange 5132, the force exerted on the toggle 5200 by the biasing member 5300 causes the toggle 5200 to translate along the longitudinal length of the toggle housing 5100 toward the second end wall 5130. In some examples, the toggle 5200 translates along the longitudinal length of the toggle housing 5100 toward the second end wall 5130 until the toggle 5200 is situated at a designated position D3.

In some examples, the toggle 5200 translates along the longitudinal length of the toggle housing 5100 toward the second end wall 5130 until an end of the second end portion 5210 contacts an interior wall surface 5150 of the toggle housing 5100. That is, in some examples, when situated in the position D3, an end of the second end portion 5210 of the toggle 5200 is in contact with (or is alternatively proximate to) an interior wall surface 5150 of the toggle housing 5100. In some examples, the toggle 5200 translates along the longitudinal length of the toggle housing 5100 toward the second end wall 5130 until the retaining pin 5400 contacts a second end 5138 of the aperture 5134 of the toggle housing 5100. That is, in some examples, when situated in the position D3, the retaining pin 5400 is in contact with (or is alternatively proximate to) the second end 5138 of the aperture 5134 of the toggle housing 5100.

Accordingly, in some examples, when the toggle assembly 5000 is positioned in the disengaged state, the toggle 5200 is situated at a position D3, as illustrated in FIGS. 23 and 24.

In some examples, the toggle 5200 is retained by the toggle housing 5100 until the toggle assembly 5000 is reengaged or reactivated. In some examples, the toggle assembly 5000 can be manually or automatically reengaged or reactivated. That is, in some examples, the toggle assembly 5000 is automatically transitioned from the disengaged state to the engaged state. In some examples, the toggle assembly 5000 is reengaged or reactivated by translating the toggle 5200 along the longitudinal length of the toggle housing 5100 away from the second end wall 5130 of the toggle housing 5100 such that the end of the second end portion 5210 clears the flange 5132 of the toggle housing 5100. In some examples, once the second end portion 5210 clears the flange 5132 of the toggle housing 5100 the toggle 5200 can be rotated about the longitudinal axis of the retaining pins 5400 away from the toggle housing 5100.

In some examples, the biasing member 5300 causes the toggle 5200 to rotate about the longitudinal axis of the retaining pins 5400 away from the toggle housing 5100 once the second end portion 5210 clears the flange 5132 of the toggle housing 5100. Specifically, as explained above, the biasing member 5300 exerts a force on the toggle 5200 and the toggle housing 5100 that influences the second end portion 5210 of the toggle 5200 to translate toward the second end wall 5130 and rotate away from the bottom 5114 of the toggle housing 5100. Accordingly, during reengagement (or priming for reengagement) of the toggle assembly 5000, once the second end portion 5210 of the toggle 5200 clears the flange 5132 of the toggle housing 5100 the biasing member 5300 causes the toggle 5200 to rotate such that the second end portion 5210 of the toggle rotates away from the bottom 5114 of the toggle housing 5100.

In some examples, further raising the lower window sash 4000 relative to the toggle assembly 5000 causes the toggle assembly to reengage. In some examples, this reengagement is automatic in that the lower window sash 4000 interacts with the toggle assembly 5000 to prime the toggle assembly 5000 for reengagement. In some such examples, after the toggle assembly 5000 is disengaged, the window sashes of the fenestration assembly 1000 can be further moved relative to one another.

For instance, in some examples, after the toggle assembly 5000 is disengaged, the lower window sash 4000 can be opened further relative to the upper window sash 3000 because the toggle 5200 of the toggle assembly 5000 no longer obstructs the lower window sash 4000. In some examples, as the lower window sash 4000 is further opened relative to the upper window sash 3000 the lower window sash 4000 engages or otherwise contacts the toggle 5200 of the toggle assembly 5000. In some examples, as the lower window sash 4000 is further opened relative to the upper window sash 3000, the strike plate 6000 contacts the toggle 5200 of the toggle assembly 5000.

Figure 25:
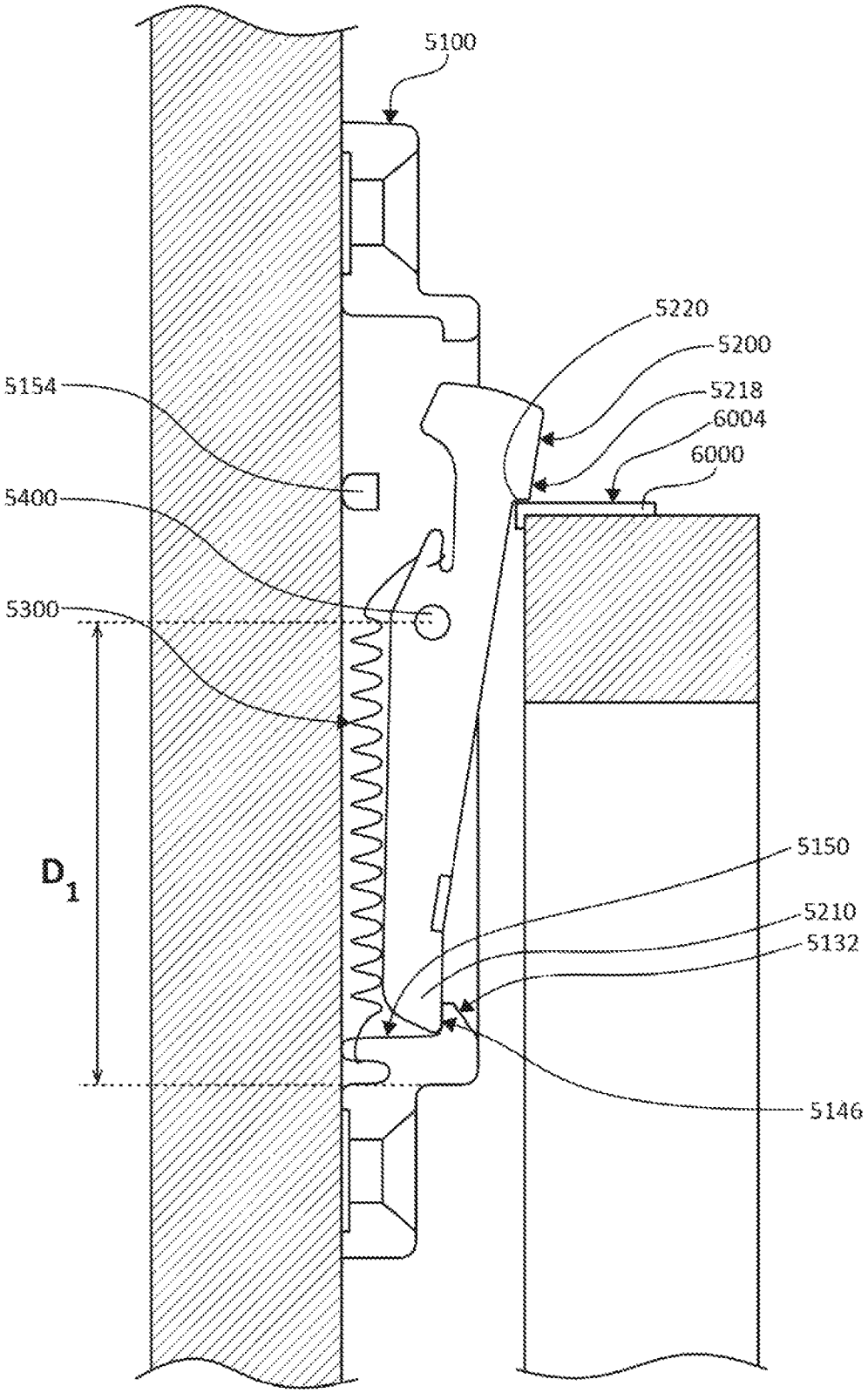
FIG. 25 is a cross-section view of the fenestration assembly taken along line 17-17 of FIG. 17 illustrating the toggle assembly and lower window sash, according to some examples.

FIGS. 25 to 29 illustrate the priming and automatic reengagement or reactivation of the toggle assembly 5000. FIG. 25 illustrates the toggle assembly 5000 in the disengaged state with the lower window sash 4000 having been opened to a position wherein the strike plate 6000 is positioned proximate the first end portion 5208 of the toggle 5200. As illustrated, upon further opening of the lower window sash 4000, the strike plate 6000 is poised to contact the toggle 5200. For instance, as illustrated, the top surface 6004 of the strike plate 6000 is poised to contact a reaction surface 5220 of a priming feature 5218 of the toggle 5200. As explained below, this contact between the strike plate 6000 and the toggle 5200 operates to prime the toggle assembly for reactivation or reengagement.

In some examples, as the lower window sash 4000 is further raised relative to the toggle assembly 5000, the strike plate 6000 contacts the toggle 5200, causing the priming feature 5218 of the toggle 5200 to hang (or otherwise bind) on the top surface 6004 of the strike plate 6000. This hanging or binding of the toggle 5200 on the strike plate 6000 causes the toggle 5200 to translate relative to the toggle housing 5100. Thus, in some examples, as the lower window sash 4000 (and thus the strike plate 6000) is further raised relative to the toggle housing 5100, the toggle 5200 is translated relative to the toggle housing 5100.

Figure 26:
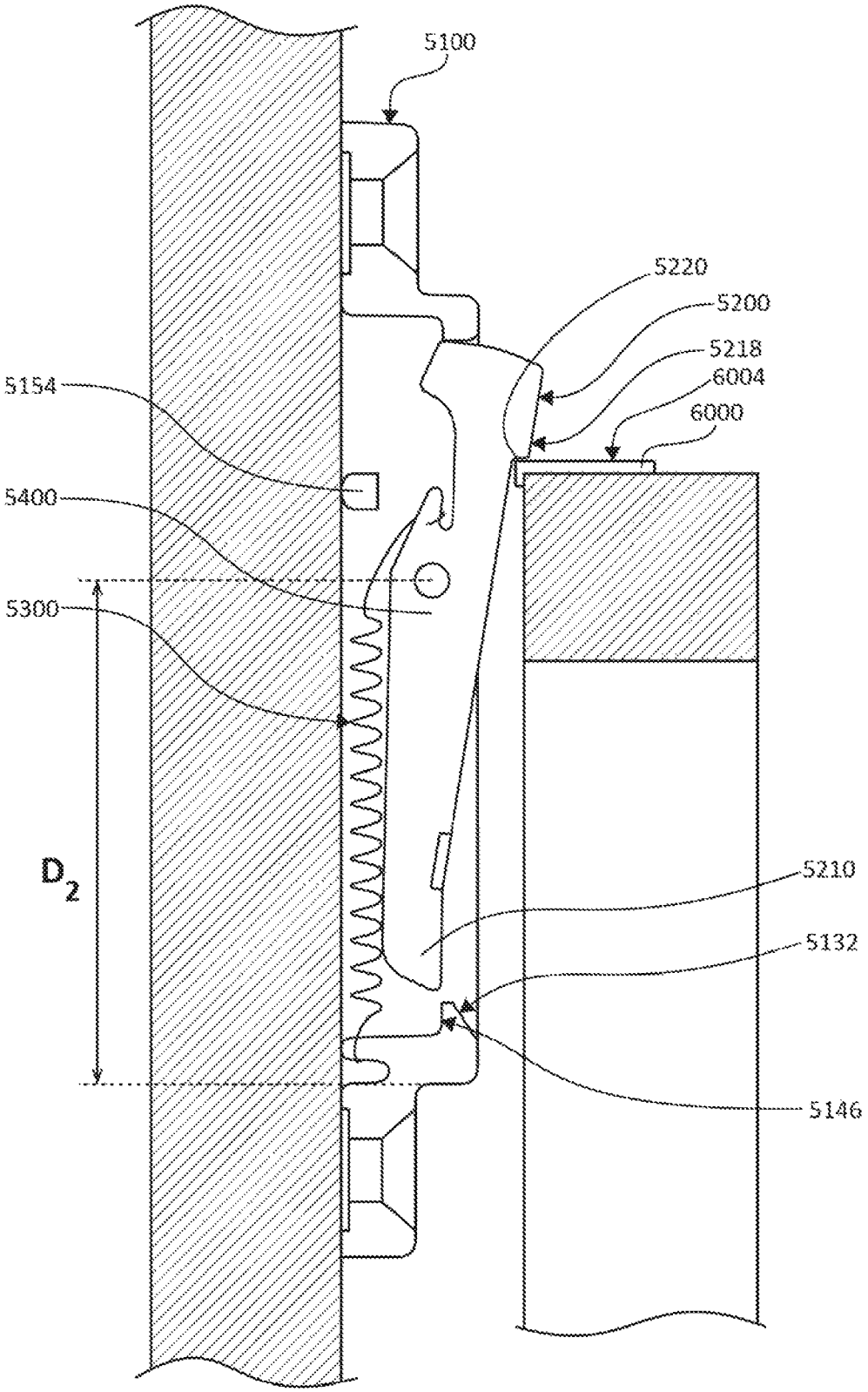
FIG. 26 is a cross-section view of the fenestration assembly taken along line 17-17 of FIG. 17 illustrating the toggle assembly and lower window sash, according to some examples.

In some examples, similar to the discussion above, this translation of the toggle 5200 relative to the toggle housing 5100 is constrained and governed by the translation of the retaining pins 5400 within the apertures 5134 of the toggle housing 5100. For example, as illustrated in FIG. 26, as a result of being carried by the strike plate 6000, the toggle 5200 has translated to position D2. As explained above, in position D2, the end of the second end portion 5210 clear of the flange 5132 and the retention surface 5146.

In some examples, when the second end portion 5210 clears the flange 5132 and the toggle 5200 is free to rotate about the longitudinal axis of the retaining pins 5400, the biasing member 5300 causes the second end portion 5210 of the toggle 5200 to rotate away from the bottom 5114 of the toggle housing 5100. That is, as discussed above, the force exerted on the toggle 5200 by the biasing member 5300 influences the second end portion 5210 of the toggle 5200 to rotate away from the bottom 5114 of the toggle housing 5100. In some examples, this rotation of the toggle 5200 operates to prime the toggle assembly 5000 for reengagement.

Figure 27:
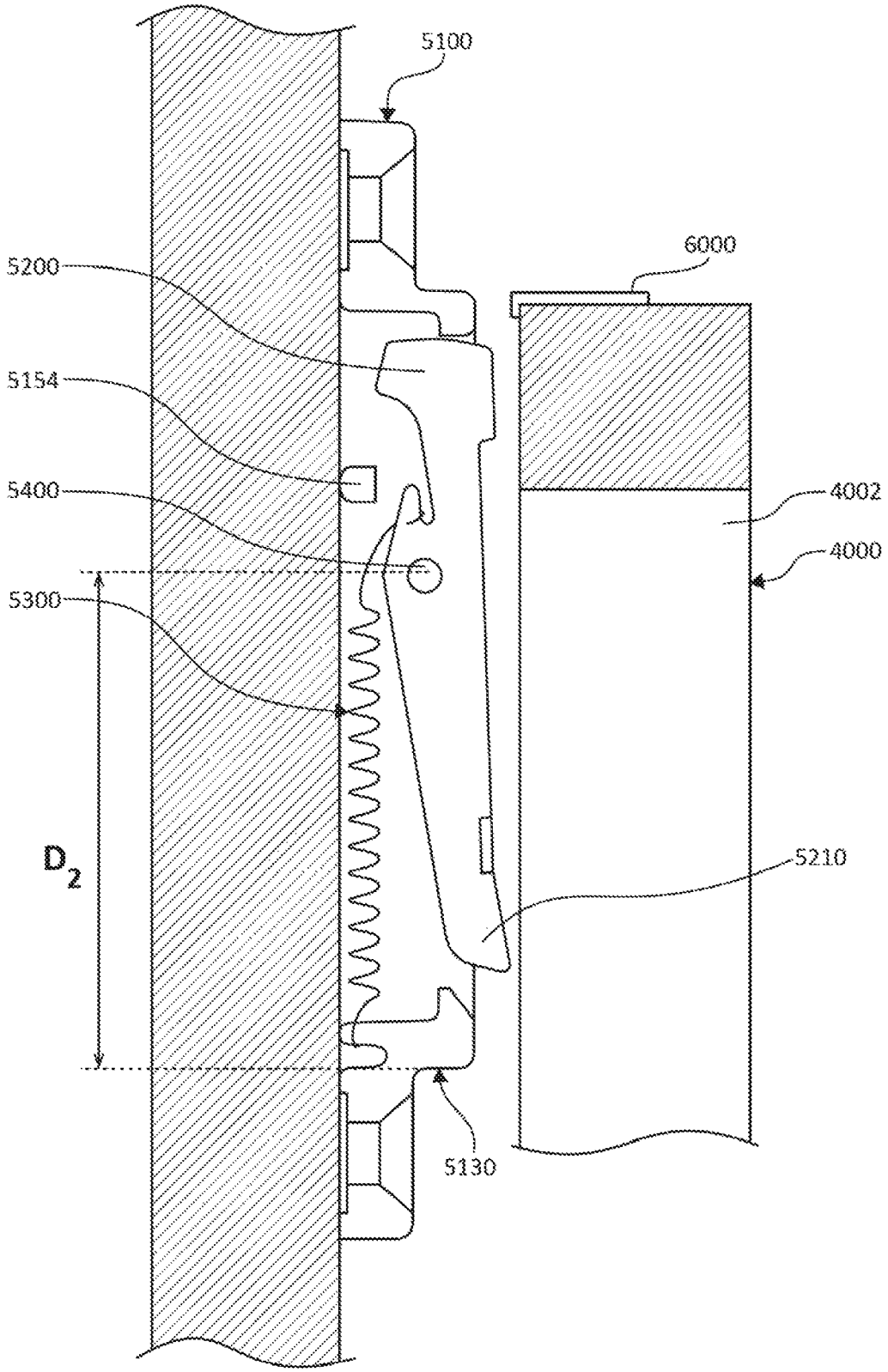
FIG. 27 is a cross-section view of the fenestration assembly taken along line 17-17 of FIG. 17 illustrating the toggle assembly and lower window sash, according to some examples.

Specifically, in some examples, as the toggle 5200 rotates as a result of the force exerted by it by biasing member 5300, the first end portion 5208 of the toggle 5200 rotates away from the strike plate 6000 such that the toggle 5200 is no longer carried by the strike plate 6000. FIG. 27 illustrates a primed toggle assembly 5000 wherein the reaction surface 5220 of the priming feature 5218 is no longer in contact with the top surface 6004 of the strike plate 6000. Accordingly, In some examples, the toggle assembly 5000 is primed when the toggle 5200 is free to rotate away from the bottom 5114 of the toggle housing 5100 (e.g., FIGS. 26 and 27). However, in some examples, a toggle that is primed for reengagement is not necessarily a toggle that is reengaged.

For example, in some instances, while the toggle 5200 is free to rotate away from the bottom 5114 of the toggle housing 5100 once the end of the second end portion 5210 clears of the flange 5132 and the retention surface 5146, the toggle 5200 may not be free to fully reengage. That is, the toggle 5200 may not be free to rotate to a position that obstructs further raising of the lower widow sash 3000 (or, alternatively, further lowering of the upper window sash 3000). With specific reference to FIG. 27, in some examples, the lower window sash 4000 may be raised to a position that obstructs the toggle assembly 5000 from fully reengaging after it has been primed.

FIG. 27 illustrates a scenario wherein the frame 4002 of lower window sash 4000 obstructs the toggle 5200 from rotating to a position that obstructs the further raising of the lower widow sash 3000 (or, alternatively, further lowering of the upper window sash 3000). Thus, although the toggle assembly 5000 has been primed to reengage, it is not reengaged. In some examples, the toggle assembly 5000 will automatically reengage once the lower window sash 4000 clears the toggle 5200 such that the toggle 5200 can rotate to a position wherein the toggle assembly is fully engaged (i.e., the toggle assembly 5000 is positioned obstruct a designated degree of relative movement between the upper and lower window sashes 3000 and 4000, as outlined above).

In some examples, once the toggle 5200 has rotated to a position where it is no longer carried by the strike plate 6000, the toggle 5200 translates along the longitudinal length of the toggle housing 5100 in a direction toward the second end wall 5130. As discussed above, in some examples, the biasing member 5300 causes the toggle 5200 to translate in such a manner. In some examples, the toggle 5200 translates along the longitudinal length of the toggle housing to a position D1. In some examples, the position D1 is associated with the retaining pin 5400 contacting (or is alternatively being situated proximate to) the second end 5138 of the aperture 5134 of the toggle housing 5100.

Figure 28:
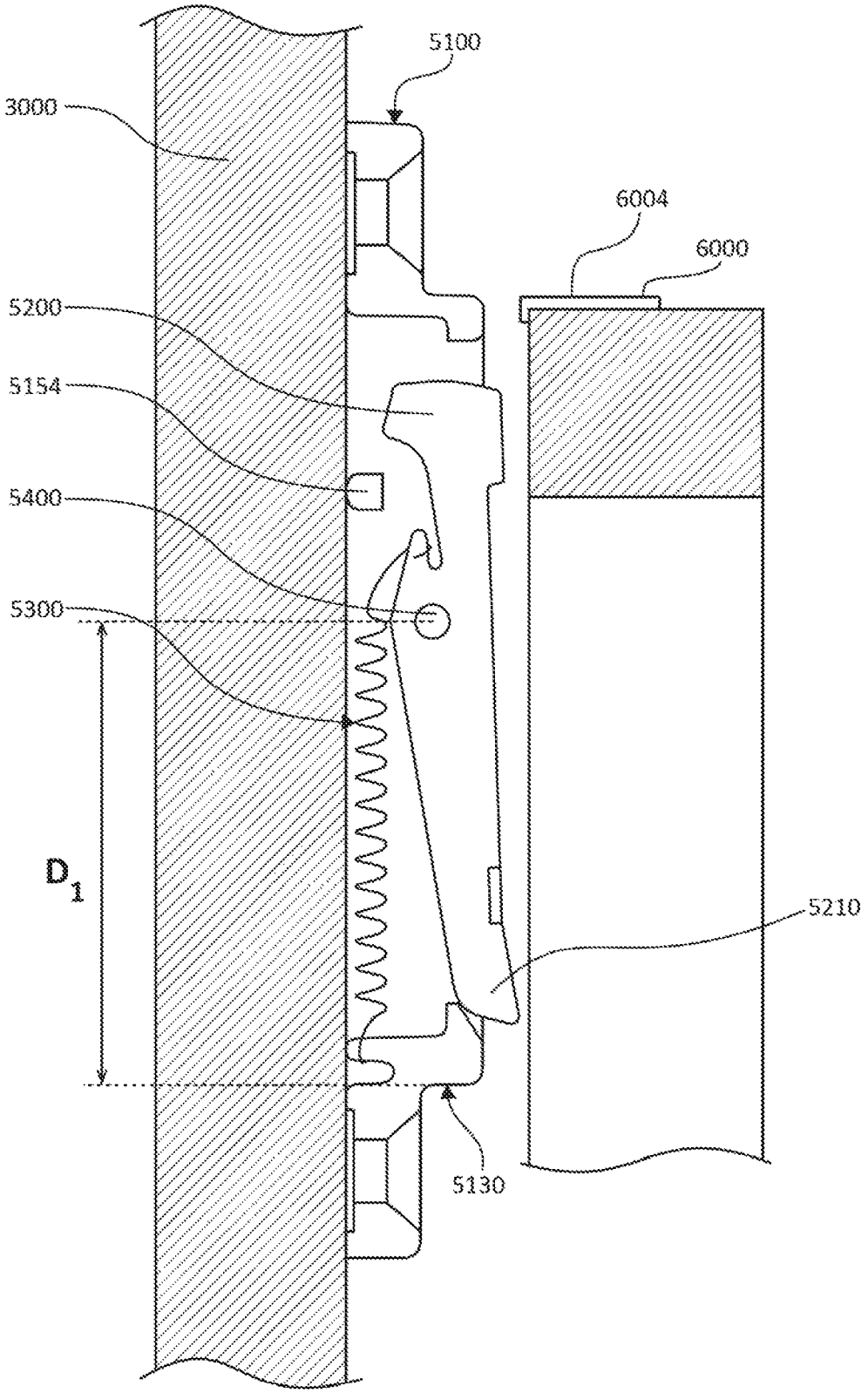
FIG. 28 is a cross-section view of the fenestration assembly taken along line 17-17 of FIG. 17 illustrating the toggle assembly and lower window sash, according to some examples.

FIG. 28 illustrates the toggle 5200 translated to the position D1. Additionally, as illustrated in FIG. 28, while the toggle assembly 5000 is primed for reengagement it is not engaged, and the lower window sash 4000 is free to be raised and lowered relative to the upper window sash 3000. That is, when in the primed configuration, the toggle assembly 5000 does not operate to obstruct lowering and raising of the lower window sash 4000 relative to the upper window sash 3000. Instead, when in the primed configuration, the toggle assembly 5000 is poised to automatically reengage once the lower window sash 4000 is lowered to a designated position relative to the upper window sash 3000. In some examples, such a designated position is one in which the top surface 6004 of the strike plate 6000 clears the end of the second end portion 5210 of the toggle 5200 such that that toggle 5200 can further rotate away from the toggle housing 5100 as explained above. In some examples, such a designated position is one in which frame 4002 of the lower window sash 4000 clears the end of the second end portion 5210 of the toggle 5200 such that that toggle 5200 can further rotate away from the toggle housing 5100 as explained above.

Figure 29:
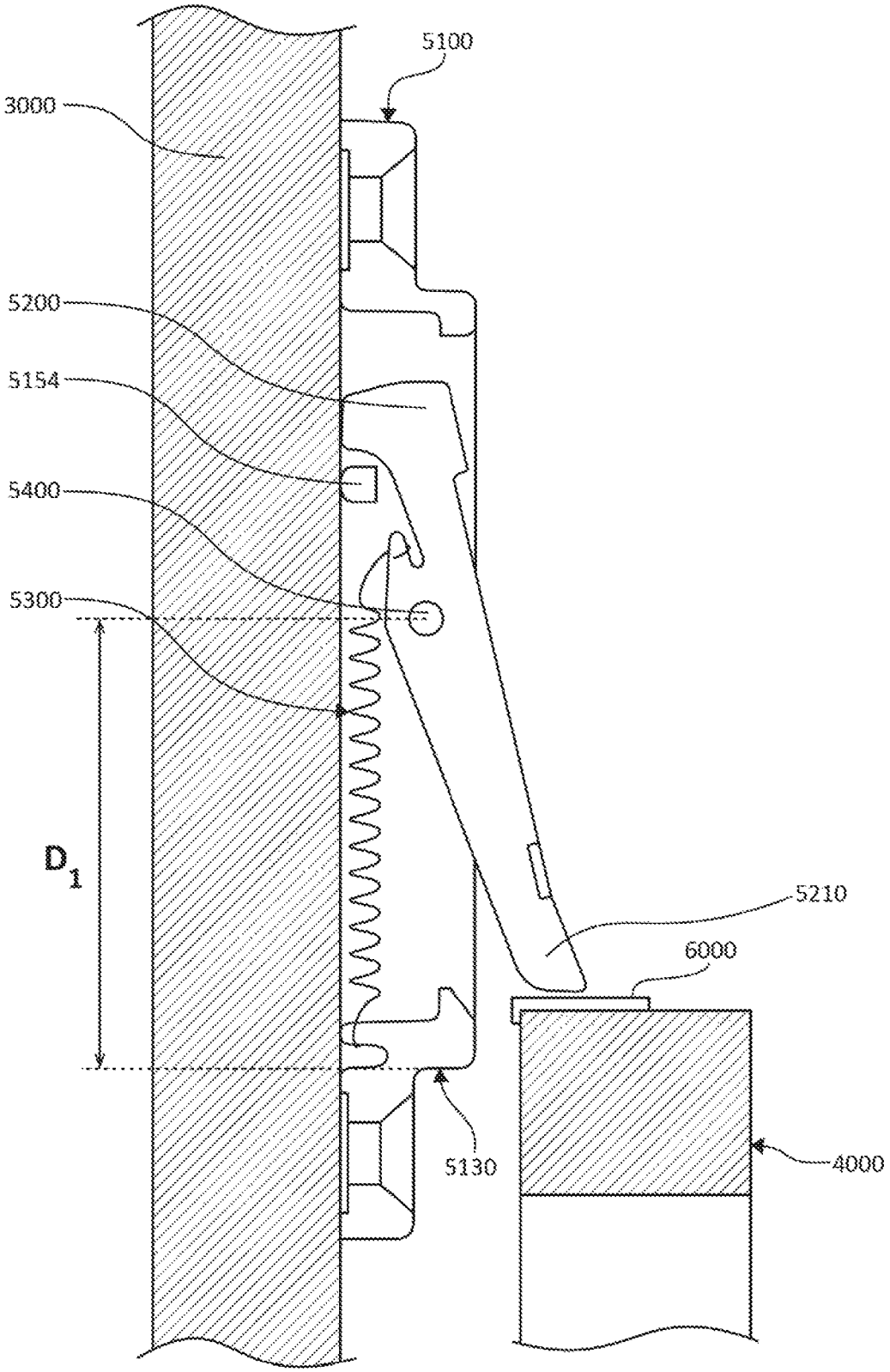
FIG. 29 is a cross-section view of the fenestration assembly taken along line 17-17 of FIG. 17 illustrating the toggle assembly and lower window sash, according to some examples.

Turning now to FIG. 29, in some examples, once the lower window sash 4000 is lowered beyond a designated position, the toggle assembly 5000 becomes reengaged. That is, once the lower window sash 4000 is lowered beyond a designated position, the toggle assembly 5000 is free to further rotate away from the toggle housing 5100 such that the toggle assembly 5000 operates to obstruct raising the lower window sash 4000 beyond a designated relative position, as described above. As illustrated in FIG. 29, the lower window sash 4000 is illustrated in a position where it has been sufficiently lowered relative to the upper window sash 3000 that the toggle assembly 5000 has transitioned to an engaged position. Specifically, the toggle 5200 is rotated such that it is poised to physically contact the strike plate 6000 if the lower window sash 4000 is raised relative to the upper window sash 3000 (or, alternatively, if the upper window sash 3000 is lowered relative to the lower window sash 4000).

While certain of the above discussed examples illustrate and describe the lower window sash 4000 being opened or otherwise raised relative to the upper window sash 3000, it will be appreciated that the toggle assembly 5000 operates in a similar or same manner if when the upper window sash 3000 is additionally or alternatively lowered relative to the lower window sash 4000. That is, in some examples, the toggle assembly 5000 operates to control the degree of relative movement between the upper and lower window sashes 3000 and 4000. Accordingly, in various examples, the toggle assembly 5000 may operate to control or otherwise limit the degree of relative movement or translation of the upper and lower window sashes 3000 and 4000. In various examples, as explained above, the toggle assembly 5000 may be automatically reengaged in accordance with the lower window sash 4000 being opened, raised, or otherwise translated a designated degree relative to the upper window sash 3000. Likewise, in various examples, the toggle assembly 5000 may be automatically reengaged in accordance with the upper window sash 3000 being lowered or otherwise translated a designated degree relative to the lower window sash 4000. This, in various examples, the toggle assembly 5000 may be automatically reengaged in accordance with the upper and lower window sashes 3000 and 4000 being translated a designated amount relative to one another.

In some examples discussed herein, the toggle assembly 5000 operates to obstruct the lower window sash from being opened, raised, or otherwise translated beyond a threshold. In some examples, the threshold is based on a designated degree (or amount) of relative translation between the upper and lower window sashes 3000 and 4000. In some examples, the threshold corresponds to an designated amount to which a lower window sash may be opened halfway. In some such examples, the threshold can be predesignated in that the fenestration system may be installed with the threshold already set. In some examples, the threshold may be in the range of two (2) to six (6) inches, such as four (4) inches, for example. In some embodiments, the threshold may be less than two (2) inches, such as in the range of zero (0) to two (2) inches. Thus, in some examples, the threshold may be set such that the lower (or upper) sash may not be opened at all. In some examples, the threshold may be greater than six (6) inches, such as within a range of six (6) inches and the amount to which the lower (or upper) sash may be opened if no toggle assembly 5000 were present. In some examples, the threshold can be selected by the fenestration system owner at the time of installation. In other words, in these examples, one fenestration system owner may select a threshold that differs from another fenestration system owner. In some examples, the threshold is fixed. In other examples, the threshold is variable in that it can be selectively modified after installation and during the life cycle of the fenestration system.

In some such examples, the threshold is modified by remounting the toggle assembly 5000 on the fenestration system in a different position, such as a position that corresponds to a greater distance between the toggle assembly 5000 and the strike plate 6000 when the upper and lower window sashes 3000 and 4000 are in their closed positions. In some other examples, the toggle assembly 5000 is mounted to the fenestration system on a track that enables repositioning of the toggle assembly along the track. For example, the track may span a vertical frame member from an upper frame member to a lower frame member, and the toggle assembly 5000 may be selectively mounted at any position along the track. Such versatility provides owners with a capability to maximize utilization of their fenestration unit without compromising their sense of security.

As explained above, in some examples, the toggle housing 5100 includes one or more slotted apertures 5134 that are configured to receive retaining pins 5400 therein such that retaining pins 5400 are free to translate and rotate within the slotted apertures 5134. Also, as explained above, toggle 5200 includes one or more retaining pin housings 5216 that are configured to receive the retaining pins 5400. In some examples, the one or more retaining pin housings 5216 of the toggle 5200 are slotted such that they have a length L that is greater than their width W. That is, in some examples, the one or more retaining pin housings 5216 of the toggle 5200 are slotted in addition to or alternative to the apertures 5134 of the toggle housing 5100 being slotted. In some examples, slotting the retaining pin housings 5216 in addition to the apertures 5134 provides for additional degrees of freedom.

As discussed above, in some examples, the retaining pin 5400 is received within the retaining pin housing 5216 of the toggle 5200. In some examples, the retaining pin 5400 is press fit (or friction fit) into the retaining pin housing 5216 such that the retaining pin 5400 is fully constrained relative to the toggle 5200. In some examples, the retaining pin 5400 is received within the retaining pin housing 5216 such that the retaining pin 5400 is free to rotate relative to the toggle 5200. As additionally described above, in some examples, the retaining pin is received within the apertures 5134 such that the retaining pins are free to rotate and/or translate within the apertures 5134. That is, in some examples, the retaining pins are free to rotate and/or translate relative to the toggle housing 5100. In some examples, the retaining pins 5400 are press fit into the apertures 5134 such that the retaining pins 5400 are fully constrained against movement relative to the toggle housing 5100. In some examples, the retaining pins 5400 are received within the apertures 5134 such that the retaining pins are free to rotate relative to the toggle housing 5100.

Thus, while some of the above discussed examples illustrate the toggle 5200 and retaining pins 5400 rotating and translating relative to the toggle housing 5100, in some examples, the toggle 5200 may rotate and translate relative to the toggle housing 5100 while the retaining pins 5400 are constrained against translation and/or rotation relative to the toggle housing 5100.

As discussed above, in some examples, the toggle 5200 is free to translate and rotate relative to the toggle housing 5100. In some examples, this translation and rotation occurs as a result of the toggle 5200 contacting the toggle housing 5100 as the toggle 5200 is rotated into the toggle housing 5100. In some examples, the retaining pin 5400 may be cammed such that the toggle 5200 translates as it rotates into the toggle housing 5100. In some such examples, the retaining pin 5400 may include one or more cammed portions that cause the toggle 5200 to translate relative to the toggle housing 5100 as the toggle 5200 rotates relative to the toggle housing 5100.

As discussed above, in some examples, the biasing member 5300 is an elastic member, such as a spring or the like that exerts a force on the toggle 5200 and the toggle housing 5100 that induces the toggle 5200 to rotate and translate relative to the toggle housing 5100. In some examples, like those described above, the biasing member 5300 exerts a force on the toggle 5200 and the toggle housing 5100 as a result of the biasing member 5300 being in tension. For instance, the biasing member 5300 in the above illustrated examples extends between the toggle 5200 and the second end portion 5106 of the toggle housing 5100 and induces the toggle 5200 to translate toward the second end portion 5106. In some other examples, the biasing member 5300 may be an elastic member that exerts a force on the toggle 5200 and the toggle housing 5100 as a result of being in compression.

Additionally, while the examples discussed above illustrate and describe the biasing member 5300 being coupled to the toggle 5200 and the toggle housing 5100, in some examples, the biasing member 5300 is coupled to the retaining pin 5400 and the toggle housing 5100. For example, the retaining pin 5400 may include one or more features that enable the biasing member 5300 to couple to (or otherwise exert a force on) the retaining pin 5400 such that the biasing member 5300 causes the toggle 5200 to rotate and translate relative to the toggle housing 5100. Additionally, in some examples, the biasing member 5300 may be coupled to the toggle 5200 and the retaining pin 5400 such that the biasing member 5300 causes the toggle 5200 to rotate relative to the toggle housing 5100. In some such examples, the retaining pin 5400 may be constrained relative to the toggle housing 5100 while being free to rotate and translate relative to the toggle 5200.

As discussed above, in some examples, the toggle assembly 5000 operates in accordance with a strike plate 6000 to prevent a designated degree of relative movement between the upper and lower window sashes 3000 and 4000. In some examples, however, no strike plate 6000 is required. That is, in some examples, the toggle assembly 5000 operates to a designated degree of relative movement between the upper and lower window sashes 3000 and 4000. In some such examples, the toggle assembly 5000 is configured to interface with the frames of the window sashes of the fenestration system 1000 to prevent a designated degree of relative movement between the upper and lower window sashes 3000 and 4000

Additionally, although the illustrated examples show the toggle assembly 5000 coupled to an upper window sash 3000, in some examples, the toggle assembly 5000 is coupled to the lower window sash 4000. In some such examples, as the lower window sash 4000 is raised relative to the upper window sash 3000 (or, alternatively, if the upper window sash 3000 is lowered relative to the lower window sash 4000), the toggle assembly operates to obstruct the lower window sash 4000 from being further raised (or, alternatively, operates to obstruct the upper window sash 3000 from being further lowered).

In some examples, a protective coating or element is coupled to the toggle 5200. In some examples, the protective coating or element is configured to protect the toggle 5200 and the various components or elements of the toggle assembly 5000 that interface with the toggle 5200. For example, in some instances, the protective coating or element protects the surface finish of the lower sash (or upper sash) from the primed toggle when the respective sash contacts the toggle 5200. In some examples, the protective coating or element may be colored such that it serves as a colored indicator to satisfy code requirements (such as visibility requirements).

Figure 30:
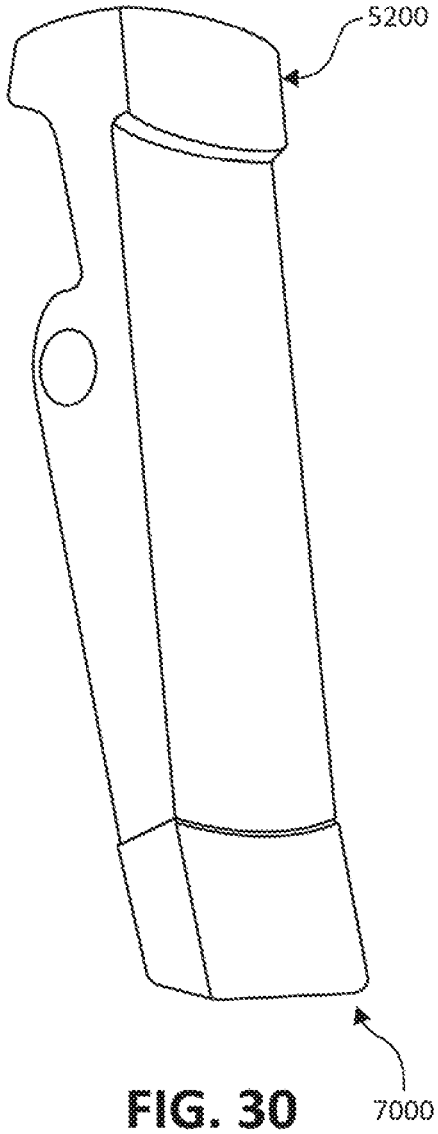
FIG. 30, is a perspective view of a toggle and protective element, according to some examples.
Figure 31A:
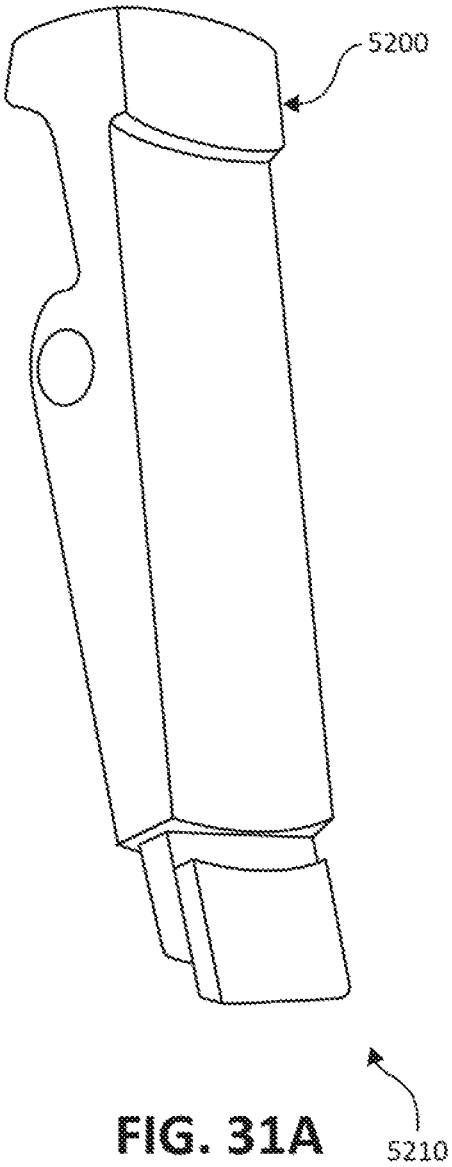
FIG. 31A is a perspective view of the toggle illustrated in FIG. 30, according to some examples.
Figure 31B:
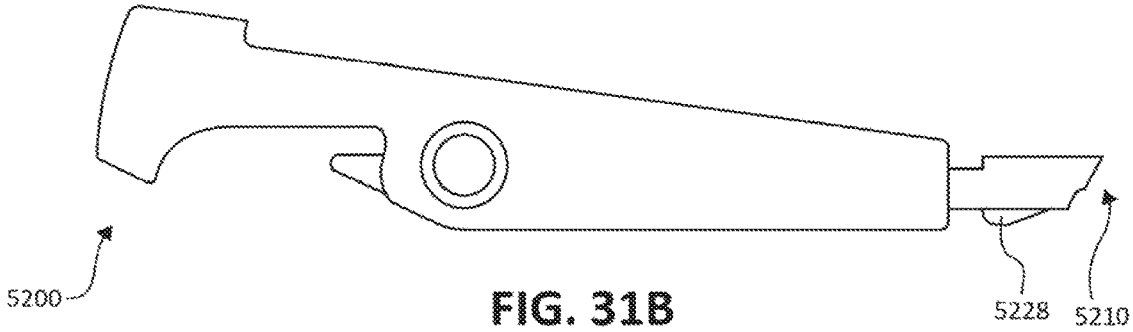
FIG. 31B is a side view of the toggle illustrated in FIG. 31A, according to some examples.
Figure 31C:
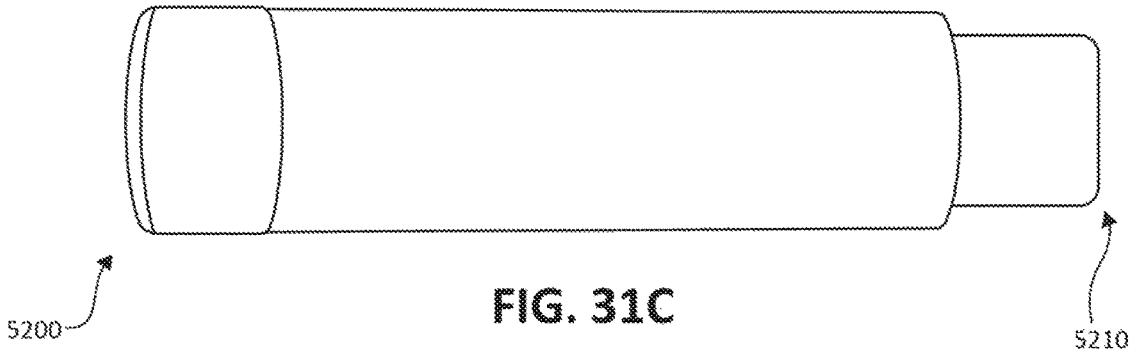
FIG. 31C is a front view of the toggle illustrated in FIG. 31A, according to some examples.
Figure 31D:
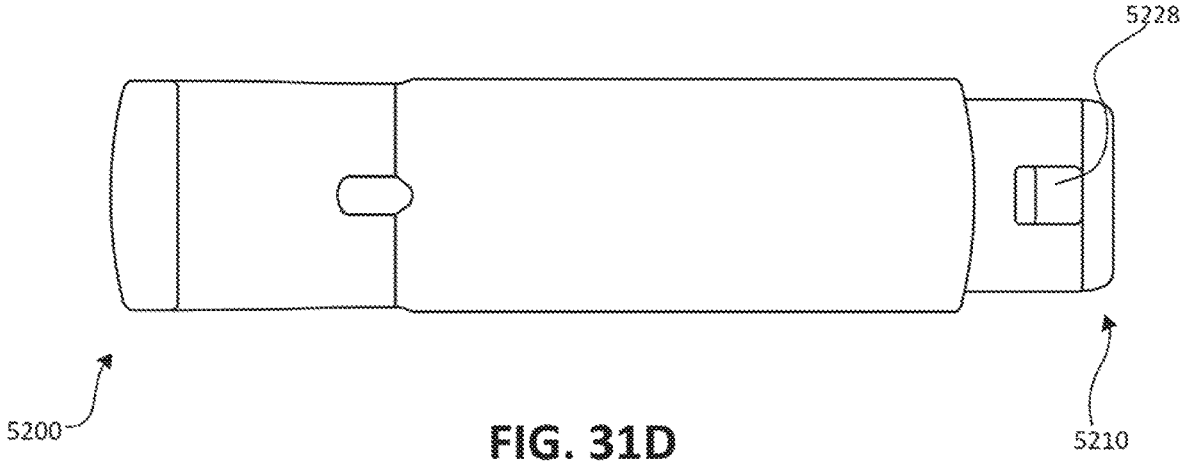
FIG. 31D is a back view of the toggle illustrated in FIG. 31A, according to some examples.

In some examples, the protective element 7000 is a coating applied to one or more portions of the toggle 5200. For example, referring now to FIGS. 30 to 32, a protective element 7000 is coupled to the second end portion 5210 of the toggle 5200. In some examples, the protective element 7000 is a coating that is applied to one or more portions of the toggle 5200, such as the second end portion 5210 (or a portion of the second end portion 5210) of the toggle 5200. In some examples, the protective element 7000 is not a coating, but is rather a separate component that is coupled to the toggle 5200. In some such examples, the protective element 7000 is removably coupled to the toggle 5200. In some other such examples, the protective element 7000 is permanently affixed to the toggle 5200.

With specific reference to FIG. 31A to 31D, in some examples, the second end portion 5210 of the toggle 5200 is configured to receive the protective element 7000 thereon. In some examples, the protective element 7000 couples to the second end portion 5210 of the toggle 5200 via one or more retention features 5230.

Figure 32A:
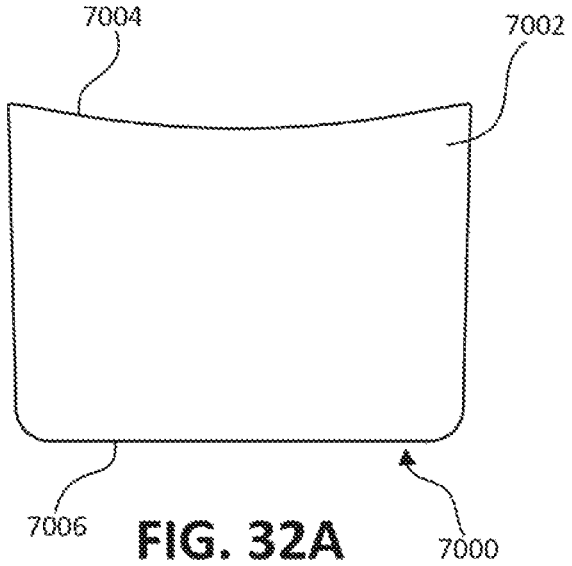
FIG. 32A is a front view of the protective element illustrated in FIG. 30, according to some examples.
Figure 32B:
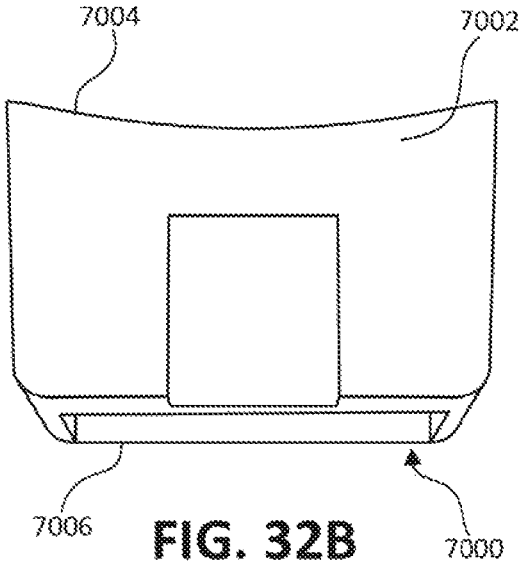
FIG. 32B is a back view of the protective element illustrated in FIG. 30, according to some examples.
Figure 32C:
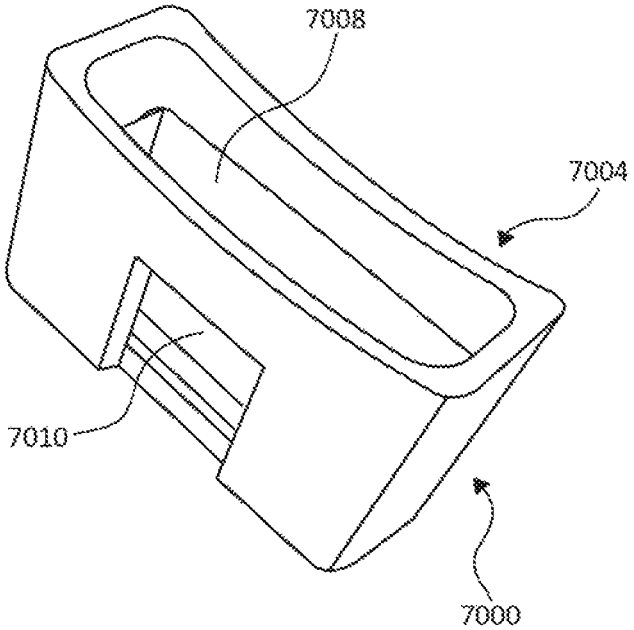
FIG. 32C is a perspective view of the protective element illustrated in FIG. 30, according to some examples.

Referring now to FIGS. 32A to 32C, in some examples, the protective element 7000 includes a body 7002, a first end portion 7004 and a second end portion 7006. In some examples, the protective element 7000 has a recess 7008 formed therein. In some such examples, the recess 7008 is configured to receive the second end portion 5210 (or a portion of the second end portion 5210) therein. In some examples, the protective element 7000 has one or more apertures 7010 formed therein. In some such examples, the one or more apertures 7010 are configured to interface with the one or more retention features 5230 of the toggle 5200 to retain the protective element 7000 on the toggle 5200.

In some examples, the coating or protective element is made of a durable polymer such as poly-propylene, or any suitable plastic or synthetic material (e.g., nylon, UHMW, santoprene, natural rubber, polycarbonate, etc.).

Numerous characteristics and advantages have been set forth in the preceding description, including various alternatives together with details of the structure and function of the devices and/or methods. Moreover, the inventive scope of the various concepts addressed in this disclosure has been described both generically and with regard to specific examples. The disclosure is intended as illustrative only and as such is not intended to be exhaustive. It will be evident to those skilled in the art that various modifications may be made, especially in matters of structure, materials, elements, components, shape, size, and arrangement of parts including combinations within the principles of the disclosure, to the full extent indicated by the broad, general meaning of the terms in which the appended claims are expressed. To the extent that these various modifications do not depart from the spirit and scope of the appended claims, they are intended to be encompassed therein.

What is claimed is:

1. A fenestration system including:

a frame;

a first window sash movable relative to the frame; and a toggle assembly including a toggle housing, a toggle, a pin, and a biasing member, the toggle assembly being transitionable between an engaged state and a disengaged state, wherein when transitioned to the engaged state the toggle assembly operates to obstruct the first window sash from being opened beyond a designated threshold position relative to the frame, and wherein when transitioned to the disengaged state the first window sash is free to be opened beyond the designated threshold position such that upon opening the first window sash beyond the designated threshold position the toggle assembly is primed to automatically transition to the engaged state upon closing the first window sash, the pin being operable to translate relative to the toggle housing.

2. The fenestration system of claim 1, wherein the toggle is configured to engage the first window sash in the engaged state to prevent the first window sash from moving beyond the designated threshold position.

3. The fenestration system of claim 1, wherein the toggle is configured to engage a portion of the frame in the engaged state to prevent the first window sash from moving beyond the designated threshold position.

4. The fenestration system of claim 1, wherein when configured in the disengaged state the toggle housing obstructs the toggle from preventing the first window sash from moving beyond the designated threshold position.

5. The fenestration system of claim 1, wherein the toggle is operable to simultaneously rotate and translate relative to the toggle housing when the toggle assembly is transitioned between the engaged state and the disengaged state.

6. The fenestration system of claim 1, wherein the toggle assembly is configured to automatically transition to the engaged state without requiring a user to manipulate the toggle independently of opening the first window sash beyond the designated threshold position.

7. The fenestration system of claim 1, wherein the toggle further comprises a portion that is configured to engage the first window sash as the first window sash is opened beyond the designated threshold position such that the toggle assembly is primed to automatically transition to the engaged state upon closing the first window sash.

8. The fenestration system of claim 1, wherein upon opening the first window sash beyond the designated threshold position the toggle assembly is primed to automatically transition to the engaged state upon closing the first window sash beyond the designated threshold position.

9. The fenestration system of claim 1, further comprising a second window sash movable relative to the first window sash, wherein when transitioned to the engaged state the toggle assembly operates to prevent the first and second window sashes from moving in excess of a designated amount relative to one another, and wherein when transitioned to the disengaged state the first and second window sashes are free to move in excess of the designated amount relative to one another.

10. The fenestration system of claim 9, wherein when transitioned to the engaged state, the first and second window sashes are movable relative to one another up to the designated amount, wherein the designated amount includes at least a partial opening of one or more of the first and second window sashes.

11. The fenestration system of claim 9, wherein the toggle further comprises a portion that is configured to engage one of the first and second window sashes as the first and second window sashes are moved in excess of the designated amount to prime the toggle assembly to automatically transition to the engaged state.

12. The fenestration system of claim 1, wherein when transitioned to the engaged state the first window sash is movable within the frame such that the first window sash can be at least partially opened.

13. A toggle assembly including:

a toggle housing;

a toggle coupled to the toggle housing and configured to rotate and translate relative to the toggle housing such that the toggle is transitionable between an engaged state and disengaged state; and a biasing member coupled to the toggle and to the toggle housing, the biasing member exerting a force on the toggle and the toggle housing, wherein when configured in the engaged state the toggle engages a portion of the toggle housing which operates to retain the toggle in the engaged state, where the toggle is operable to be linearly translated when the toggle is transitioned to the engaged state, and wherein when transitioning from the engaged state to the disengaged state the biasing member induces the toggle to rotate and translate relative to the toggle housing.

14. The toggle assembly of claim 13, wherein the toggle is coupled to the toggle housing such that a translation of the toggle in a first direction relative to the toggle housing operates to disengage the toggle from the portion of the toggle housing with which it is engaged in the engaged state such that the toggle is operable to automatically transition to the disengaged state.

15. A method of controlling a window sash in a fenestration system, the window sash being moveable within a frame of the fenestration system, the method comprising;

positioning a toggle assembly including a toggle housing, a toggle, and a pin on the fenestration system, the toggle assembly being transitionable between an engaged state and a disengaged state, the pin being operable to translate relative to the toggle housing;

configuring the toggle assembly in the engaged state such that the window sash is obstructed from being opened in excess of a designated amount; and transitioning the toggle assembly to the disengaged state such that the window sash can be opened in excess of the designated amount and such that upon opening the first window sash in excess of the designated amount the toggle assembly is primed to automatically transition to the engaged state upon closing the window sash.

16. The method of claim 15, wherein when obstructed from being opened in excess of a designated amount the first window sash can be at least partially opened.

17. The method of claim 15, wherein the toggle assembly includes a toggle housing and a toggle coupled to the toggle housing such that the toggle can be translated and rotated relative to the toggle housing.

18. The method of claim 15, wherein transitioning the toggle assembly to the disengaged state includes translating and rotating the toggle relative to the toggle housing such that a first portion of the toggle is captured by the toggle housing.

19. The method of claim 18, wherein the toggle housing includes a flange and wherein transitioning the toggle assembly to the disengaged state includes translating and rotating the toggle relative to the toggle housing such that the flange engages the first portion of the toggle.

20. The method of claim 15, wherein upon opening the first window sash in excess of the designated amount the toggle assembly is primed to automatically transition to the engaged state upon closing the window sash to a position where the window sash is opened less than the designated amount.

* * * * *